US011286654B2

(12) United States Patent
Rubin et al.

(10) Patent No.: US 11,286,654 B2
(45) Date of Patent: Mar. 29, 2022

(54) WASTE DISPOSER WITH EMBEDDED SPRINKLER ASSEMBLY

(71) Applicant: SQUALL E.M.T LTD., Rehovot (IL)

(72) Inventors: Tamir Rubin, Rehovot (IL); Etai Alali, Karmey Yosef (IL)

(73) Assignee: SQUALL E.M.T LTD., Rehovot (IL)

( * ) Notice: Subject to any disclaimer, the term of this patent is extended or adjusted under 35 U.S.C. 154(b) by 177 days.

(21) Appl. No.: 16/766,844

(22) PCT Filed: Oct. 10, 2019

(86) PCT No.: PCT/IL2019/051104
§ 371 (c)(1),
(2) Date: May 26, 2020

(87) PCT Pub. No.: WO2020/079680
PCT Pub. Date: Apr. 23, 2020

(65) Prior Publication Data

US 2020/0318330 A1 Oct. 8, 2020

(30) Foreign Application Priority Data

Oct. 17, 2018 (IL) ..... 262451

(51) Int. Cl.
*B02C 18/00* (2006.01)
*E03C 1/266* (2006.01)
*B02C 23/36* (2006.01)

(52) U.S. Cl.
CPC ..... *E03C 1/2665* (2013.01); *B02C 18/0092* (2013.01); *B02C 23/36* (2013.01)

(58) Field of Classification Search
CPC ..... B02C 18/0092; B02C 23/36
USPC ..... 241/46.013
See application file for complete search history.

(56) References Cited

U.S. PATENT DOCUMENTS

| | | | | |
|---|---|---|---|---|
| 2,869,794 | A | 1/1959 | Modrey | |
| 3,011,192 | A | 12/1961 | Delamater | |
| 3,159,355 | A | 12/1964 | Delamater | |
| 3,356,097 | A | 12/1967 | Schaap | |
| 4,720,050 | A * | 1/1988 | Eberhardt | B02C 18/0092 241/101.2 |
| 4,762,281 | A * | 8/1988 | Eberhardt | B02C 18/0092 241/101.2 |
| 5,971,304 | A | 10/1999 | Sullivan | |
| 9,694,365 | B1 | 7/2017 | Melin et al. | |
| 2015/0369471 | A1 | 12/2015 | Williams | |
| 2016/0200616 | A1 | 7/2016 | Platts et al. | |
| 2016/0310958 | A1 | 10/2016 | Marom | |

(Continued)

FOREIGN PATENT DOCUMENTS

| | | |
|---|---|---|
| CA | 2704169 | 11/2011 |
| CN | 204017947 | 12/2014 |
| CN | 104895160 | 9/2015 |

(Continued)

OTHER PUBLICATIONS

International Search Report, International Application No. PCT/IL2019/051104, dated Jan. 8, 2020.

*Primary Examiner* — Faye Francis
(74) *Attorney, Agent, or Firm* — The Roy Gross Law Firm, LLC; Roy Gross

(57) ABSTRACT

The present invention relates to the field of food waste disposers, and, more particularly, to food waste disposers with embedded sprinkler assemblies.

20 Claims, 21 Drawing Sheets

(56) References Cited

U.S. PATENT DOCUMENTS

| | | | | |
|---|---|---|---|---|
| 2016/0369485 | A1 | 12/2016 | Lang | |
| 2017/0239667 | A1* | 8/2017 | Hofman | B02C 18/2216 |

FOREIGN PATENT DOCUMENTS

| | | |
|---|---|---|
| CN | 105312130 | 2/2016 |
| CN | 105771414 | 7/2016 |
| CN | 206382316 | 8/2017 |
| CN | 206599825 | 10/2017 |
| CN | 107307827 | 11/2017 |
| GB | 502784 | 3/1939 |
| GB | 594329 | 11/1947 |
| GB | 663460 | 12/1951 |
| GB | 717803 | 11/1954 |
| GB | 719509 | 12/1954 |
| GB | 746659 | 3/1956 |
| GB | 790630 | 2/1958 |
| GB | 813304 | 5/1959 |
| GB | 857578 | 12/1960 |
| GB | 1040699 | 9/1966 |
| JP | 0290953 | 3/1990 |
| JP | 0790899 | 4/1995 |
| JP | 2001029829 | 2/2001 |
| JP | 2001087663 | 4/2001 |
| JP | 2014018792 | 2/2014 |
| JP | 2014079679 | 5/2014 |
| JP | 2014180613 | 9/2014 |
| JP | 2014210244 | 11/2014 |
| KR | 20080061216 | 7/2008 |
| KR | 20100012236 | 2/2010 |
| KR | 20100048207 | 5/2010 |
| KR | 20100093632 | 8/2010 |
| KR | 20100133772 | 12/2010 |
| KR | 20120050020 | 5/2012 |
| KR | 20130059090 | 6/2013 |
| KR | 20130067630 | 6/2013 |
| KR | 101460533 | 11/2014 |
| KR | 20140144775 | 12/2014 |
| KR | 20150124295 | 11/2015 |
| KR | 20150124296 | 11/2015 |
| KR | 20150130683 | 11/2015 |
| KR | 20150139712 | 12/2015 |
| KR | 20160052242 | 5/2016 |
| KR | 20160129293 | 11/2016 |
| KR | 20180026082 | 3/2018 |
| NZ | 594120 | 6/2015 |

* cited by examiner

WASTE DISPOSER WITH EMBEDDED SPRINKLER ASSEMBLY

CROSS REFERENCE TO RELATED APPLICATIONS

This application is a National Phase of PCT Patent Application No. PCT/IL2019/051104 having International filing date of Oct. 10, 2019, which claims the benefit of and priority to Israeli Application No. 262451 filed on Oct. 17, 2018. The contents of the above applications are all incorporated by reference as if fully set forth herein in their entirety.

FIELD OF THE INVENTION

The present invention relates to the field of food waste disposers, and, more particularly, to food waste disposers with embedded sprinkler assemblies.

BACKGROUND OF THE INVENTION

Food waste disposers are typically used to process solid waste, such as food waste, garbage and/or other waste, into particulates small enough to pass through associated drain plumbing. A conventional waste disposer includes a grinding mechanism that is driven by a motor, and is configured to be mounted beneath a sink drain extending downward from a corresponding sink. The grinding mechanism typically includes a rotating shredder plate with lugs and a stationary grind ring attached to the inside of its housing. In operation of the disposer, water and waste are typically directed from the sink drain, via an inlet of the waste disposer, into the grinding mechanism. The motor turns the rotating shredder plate and the lugs force the food waste against the stationary grind ring where it is shredded into small particulates. The processed waste may then be discharged and transmitted through the associated drain plumbing.

In many cases, the user pushes and directs waste accumulated in the sink towards the sink drain and into the waste disposer, either by hand-held tools, via manually held sprayers, or by hand. Moving waste portions in this manner is time consuming and somewhat messy. Thus, there is a need for a waste disposer capable of hands-free removal of waste accumulated in the sink, including potentially from dishes and utensils placed within a sink for washing thereof

SUMMARY OF THE INVENTION

The following embodiments and aspects thereof are described and illustrated in conjunction with systems, devices and methods which are meant to be exemplary and illustrative, not limiting in scope. In various embodiments, one or more of the above-described problems have been reduced or eliminated, while other embodiments are directed to other advantages or improvements.

According to some embodiments, there is provided a waste disposer equipped with a sprinkler assembly. The sprinkler assembly is connectable with a pressurized water inlet from a water supply pipe, and includes a spring-biased telescoping sprinkler tube attached to a nozzle head having at least one orifice, and preferably a plurality of orifices. The waste disposer may further include a valve. The valve may be activated by a control circuitry to either supply or stop supplying pressurized water into the sprinkler assembly, such that when the valve is open, the pressurized water urges the telescoping sprinkler tube upwards into the sink, up to a position where the nozzle head rises above the base level of the sink or the sink drain, and water is sprayed therethrough towards at least a portion of the sink. In the presence of the sprayed water waste, accumulated in the sink, flows towards the sink drain and into the upper conveying section of the waste disposer.

The waste disposer includes at least a first inlet connectable to the sink drain, a motor unit including a motor and a central shaft through which the sprinkler tube may move in a vertical direction, and grinding mechanism disposed between the first inlet and the motor unit. The first inlet receives waste accumulated in the sink and conveys it towards the grinding mechanism. The grinding mechanism includes a shredder plate rotatable by the motor, configured to force waste outwardly by centrifugal force towards a stationary grind ring.

Advantageously, the disclosed combination of a waste disposer with a pop-up sprinkler enables washing the sink without manual interference of a user, thereby directing waste accumulated therein towards the sink drain.

A further advantage of the disclosed waste disposer is that the sprinkler assembly may provide forced jet streams that can detach waste accumulated on, or attached to, dishes and utensils placed within the sink, thereby provides hand-free washing and overall improved dish washing.

A yet further advantage of the disclosed waste disposer is that it can be constructed for installation in a similar manner to that of standard waste disposers available in the market, such that the only modification is an additional connector to the inlet piping of a regular sink, adapted to supply pressurized water to operate the sprinkler assembly.

According to one aspect, there is provided a waste disposer comprising (i) a housing comprising (a) a first inlet, (b) an outlet and (c) a pressurized water inlet; (ii) a grinding mechanism comprising (a) a shredder plate comprising a shredder plate opening and at least one surface feature, and (b) a stationary grind ring comprising a plurality of stationary grind apertures disposed there around; (iii) a motor unit comprising (a) a motor and (b) a central shaft; and (iv) a sprinkler assembly comprising (a) a sprinkler tube, mounted in a vertical slideable movement within the central shaft, the sprinkler tube comprising a sprinkler tube proximal end and a sprinkler tube distal end, (b) a nozzle head connected to the sprinkler tube proximal end, configured for discharging water therefrom, and (c) a spring extending between the sprinkler tube distal end and the shredder plate, wherein the stationary grind ring is affixed to the housing, the motor is configured to impart rotational movement of the shredder plate relative to the stationary grind ring, the shredder plate opening is configured to allow passage of the sprinkler tube therethrough, and the sprinkler assembly is moveable between a bottom position and an upper position.

According to some embodiments, the waste disposer further comprises a second inlet.

According to some embodiments, the waste disposer further comprises a mounting assembly configured for mounting the waste disposer to a sink.

According to some embodiments, the motor is any one of: a permanent magnet DC motor, a brushless DC motor, a universal motor, a switched reluctance motor, a synchronous reluctance motor, or an induction motor.

According to some embodiments, the waste disposer further comprises a plate support, configured to support the shredder plate being placed thereon or attached thereto.

According to some embodiments, the motor is configured to impart rotational movement to the central shaft, which rotates the shredder plate.

According to some embodiments, the waste disposer further comprises a water inlet valve, disposed between the sprinkler tube and the pressurized water inlet.

According to some embodiments, the waste disposer further comprises a control circuitry, configured to control the operation of at least one of: the motor and the sprinkler tube.

According to some embodiments, the control circuitry is activated by a remote controller.

According to some embodiments, the waste disposer further comprises a detergent valve, configured to introduce detergent to be mixed with water inflow flowing through the pressurized water inlet.

According to some embodiments, the waste disposer further comprises a detergent valve, configured to introduce detergent to be mixed with water inflow flowing through the pressurized water inlet, wherein the control circuitry is further configured to control the operation of the detergent valve.

According to some embodiments, the waste disposer further comprises a sealing cap disposed around the shredder plate opening, comprising a cap opening configured to allow passage of the sprinkle tube therethrough.

According to some embodiments, the waste disposer further comprises a plate bearing disposed between the central shaft and the shredder plate.

According to some embodiments, the water inlet bearing, disposed around the pressurized water inlet distal to the water inlet valve.

According to some embodiments, the shredder plate comprises a plurality of surface features extending upwardly therefrom According to some embodiments, the plurality of stationary grind apertures are surrounded by cutting edges.

According to some embodiments, the nozzle head is removably attached to the sprinkler tube proximal end.

According to some embodiments, the nozzle head comprises a nozzle receiving bore, adapted to press-fit with or to threadedly attach to the sprinkler tube proximal end.

According to some embodiments, the nozzle head comprises a plurality of orifices.

According to some embodiments, at least some of the plurality of orifices are formed as nozzle apertures having a diameter of 0.25-0.35 millimeters.

According to some embodiments, the nozzle head is rotateably connected to the sprinkler tube.

According to some embodiments, the nozzle head is rotateably connected to the sprinkler tube, and wherein at least some of the plurality of orifices are oriented so as to impart rotational movement to the nozzle head.

According to some embodiments, the waste disposer further comprises a strainer configured to attach to a distal end of the nozzle head.

According to some embodiments, the strainer is magnetically attached to the nozzle head.

According to some embodiments, the nozzle head is a rotary expandable nozzle head having a nozzle proximal section, comprising at least one lateral nozzle member disposed circumferentially around the nozzle proximal section, wherein the rotary expandable nozzle head is rotateably connected to the sprinkler tube.

According to some embodiments, the at least one lateral nozzle member is configured to extend radially outwards from the circumference of the nozzle proximal section.

According to some embodiments, the rotary expandable nozzle head further comprises at least one lateral head outlet, comprising an outlet opening configured to allow passage or extension of the lateral nozzle member therethrough.

According to some embodiments, the lateral head outlet is formed as a sleeve radially extending from the circumference of the nozzle proximal section.

According to some embodiments, at least one of the lateral head outlet or the lateral nozzle member are oriented or twisted so as to impart rotary movement of the rotary expandable nozzle head.

Certain embodiments of the present invention may include some, all, or none of the above advantages. Further advantages may be readily apparent to those skilled in the art from the figures, descriptions, and claims included herein. Aspects and embodiments of the invention are further described in the specification herein below and in the appended claims.

Unless otherwise defined, all technical and scientific terms used herein have the same meaning as commonly understood by one of ordinary skill in the art to which this invention pertains. In case of conflict, the patent specification, including definitions, governs. As used herein, the indefinite articles "a" and "an" mean "at least one" or "one or more" unless the context clearly dictates otherwise.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION OF SOME EMBODIMENTS

Figure 1A:
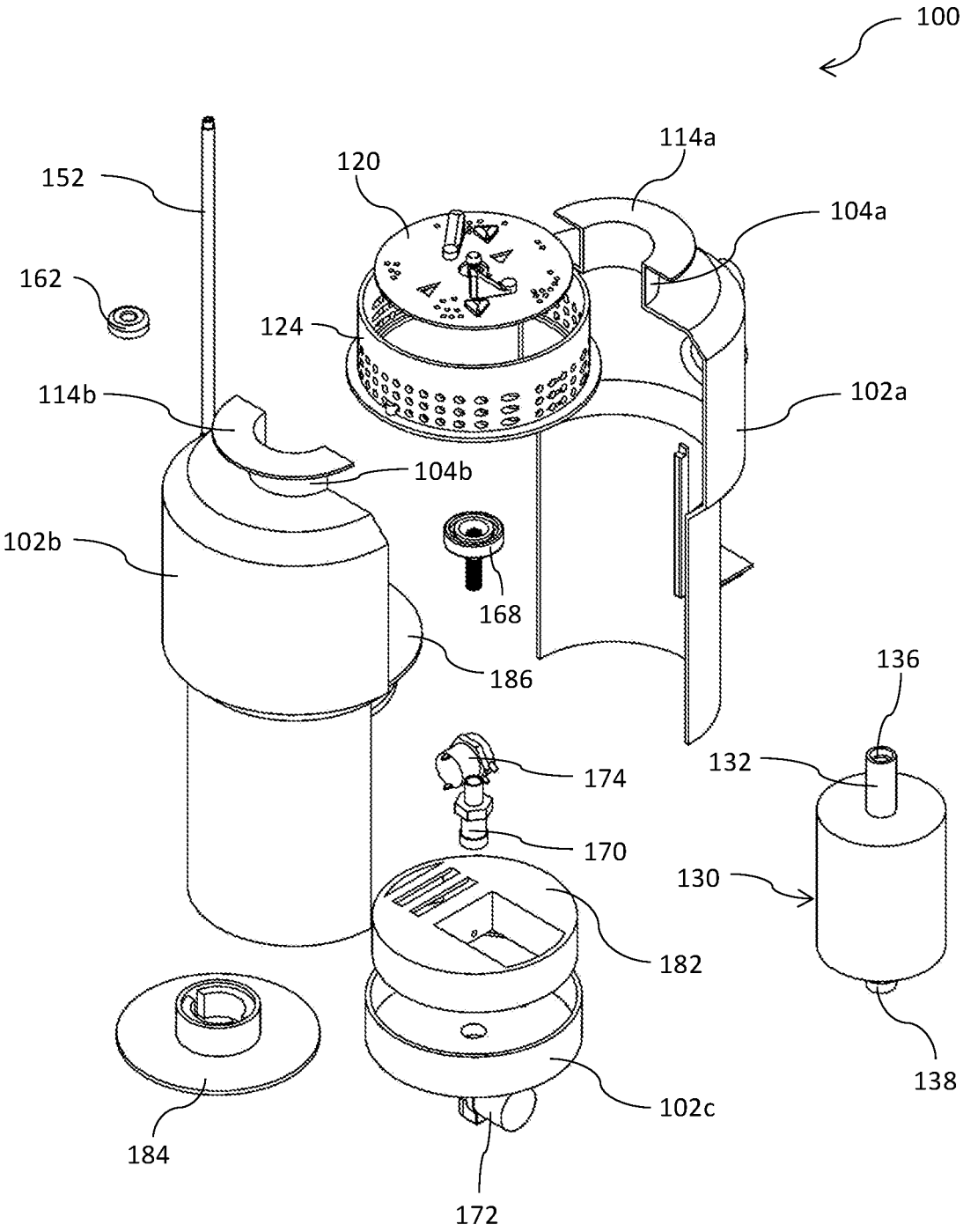
FIG. 1A constitutes an exploded view in perspective from a top-side angle of a waste disposer, according to some embodiments.
Figure 1B:
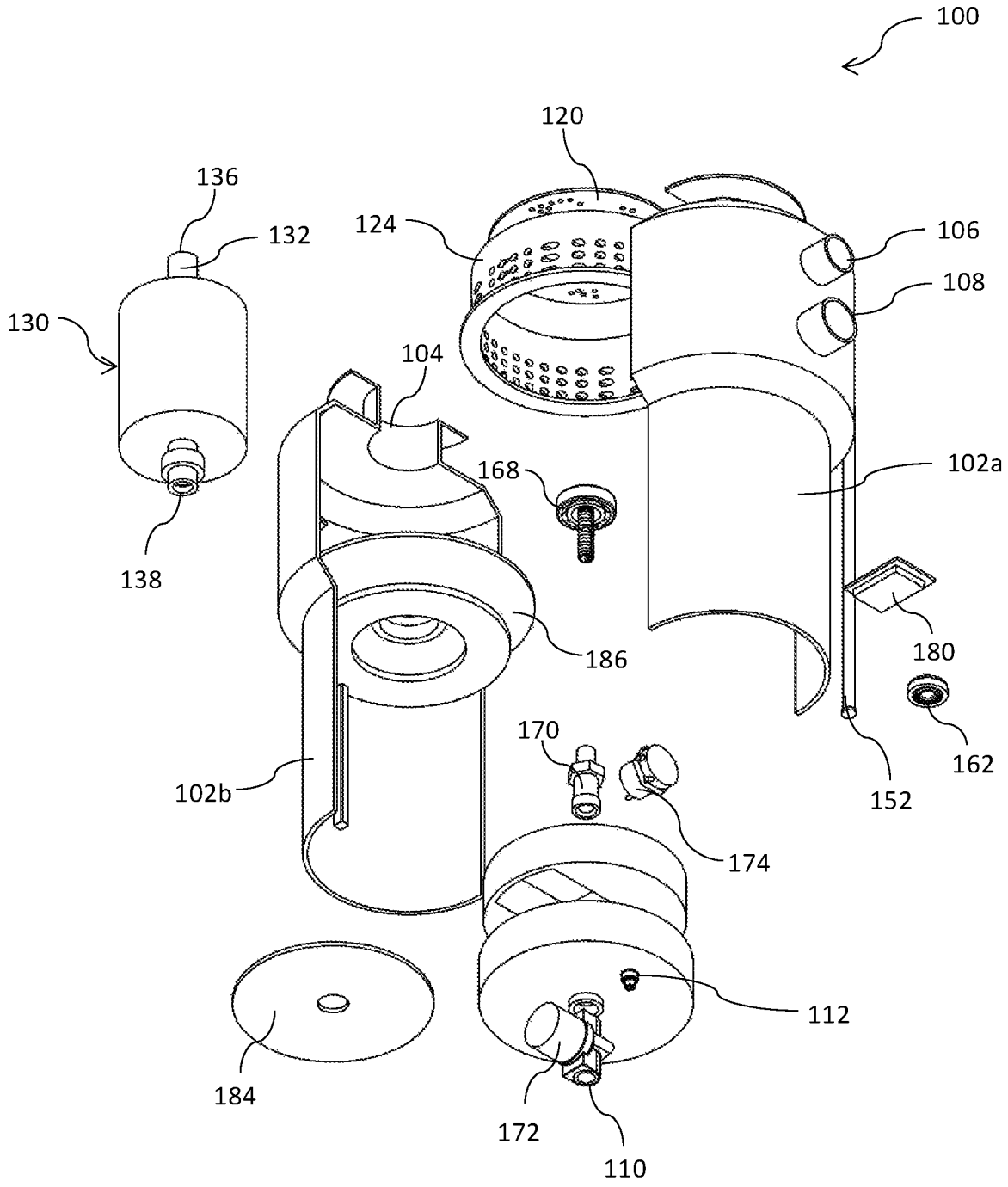
FIG. 1B constitutes an exploded view in perspective from a bottom-side angle of a waste disposer, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure. In the figures, like reference numerals refer to like parts throughout.

Throughout the figures of the drawings, different superscripts for the same reference numerals are used to denote different embodiments of the same elements. Embodiments of the disclosed devices and systems may include any combination of different embodiments of the same elements. Specifically, any reference to an element without a superscript may refer to any alternative embodiment of the same element denoted with a superscript. Components having the same reference number followed by different lowercase letters may be collectively referred to by the reference number alone. If a particular set of components is being discussed, a reference number without a following lowercase letter may be used to refer to the corresponding component in the set being discussed. In order to avoid undue clutter from having too many reference numbers and lead lines on a particular drawing, some components will be introduced via one or more drawings and not explicitly identified in every subsequent drawing that contains that component.

Reference is now made to FIGS. 1A-4. FIGS. 1A-1B constitute exploded views in perspective of a waste disposer 100, according to some embodiments. FIG. 2A constitutes a view in perspective of waste disposer 100 (depicted in FIGS. 1A-1B). FIG. 2A constitutes a view in perspective of waste disposer 100*a*. FIGS. 2A-2B constitute a view in perspective and a side view of waste disposer 100 mounted underneath a sink in a sink cabinet, respectively.

Figure 4:
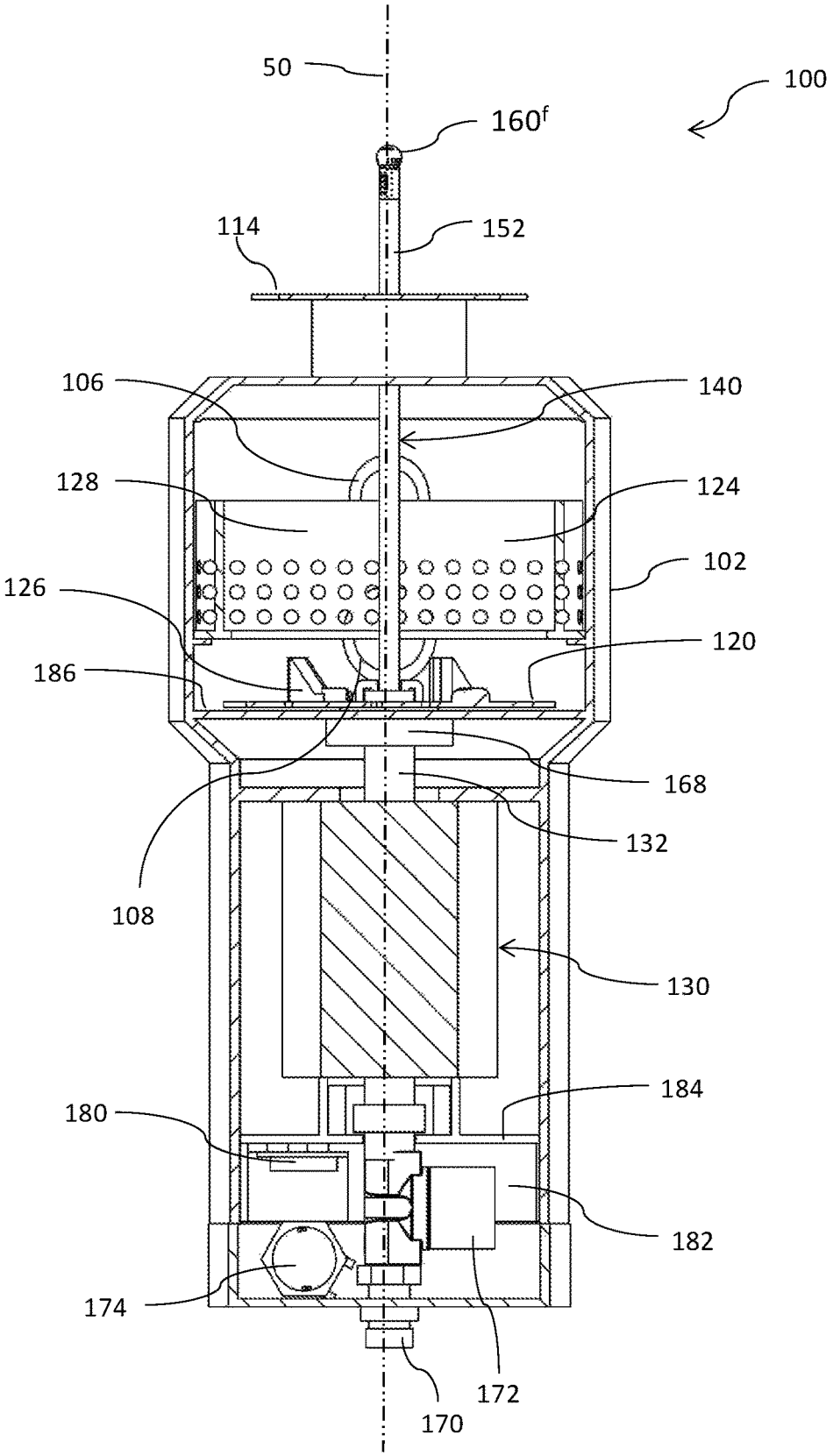
FIG. 4 constitutes a cross-sectional side view of a waste disposer, according to some embodiments.

FIG. 4 constitutes a cross-sectional side view of waste disposer 100.

According to some embodiments, waste disposer 100 comprises a housing 102 configured to form an outer casing or enclosure for at least some of the various other components of waste disposer 100. According to some embodiments, waste disposer 100 further comprises shredder plate 120 and stationary grind ring 124, together defining grinding mechanism 118. According to some embodiments, housing 102 comprises a first inlet 104 (see FIG. 2A) that is in communication with sink drain 14 (see FIG. 3A) configured for receiving food waste and water, which is conveyed towards grinding mechanism 118.

According to some embodiments, housing 102 further comprises outlet 108 configured for discharging processed waste from waste disposer 100.

According to some embodiments, housing 102 is formed as a single continuous casing. According to some embodiments, housing 102 comprises a plurality of components configured to attach to each other, such as housing components 102*a*, 102*b* and 102*c* depicted in FIGS. 1A-2A, or such as components 102*aa* and 102*ab* depicted in FIG. 2B.

The term plurality, as used herein, refers to more than one.

According to some embodiments, stationary grind ring 124 is fixedly attached to housing 102.

According to some embodiments, waste disposer 100 further comprises a motor unit 130. According to some embodiments, motor unit 130 comprises motor 134 (not shown separately), configured to impart rotational movement of shredder plate 120 relative to stationary grind ring 124, about central axis 50 (see FIG. 4).

According to some embodiments, waste disposer 100 includes a mounting assembly, configured for mounting waste disposer 100 to sink 10. According to some embodiments, housing 102 comprises mounting portion 114, which constitutes part of the mounting assembly and is configured for attachment of housing 102 to sink 10 or more particularly, to sink drain 14.

Figure 2B:
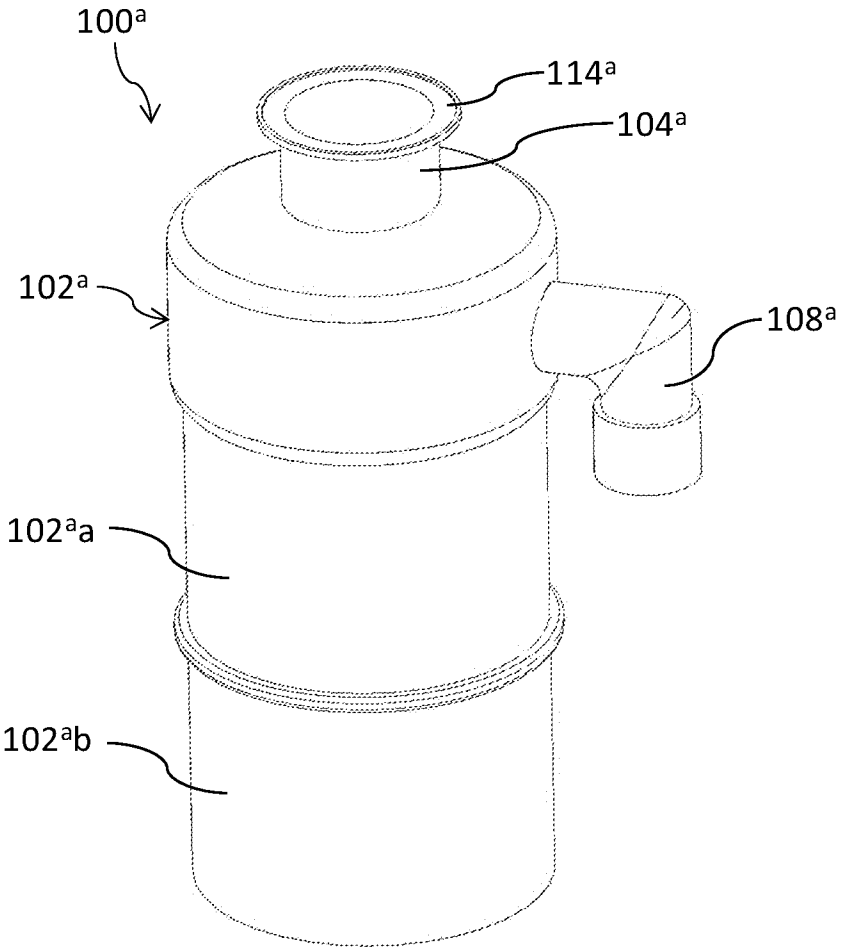
FIG. 2B constitutes a view in perspective of a waste disposer, according to some embodiments.
Figure 2A:
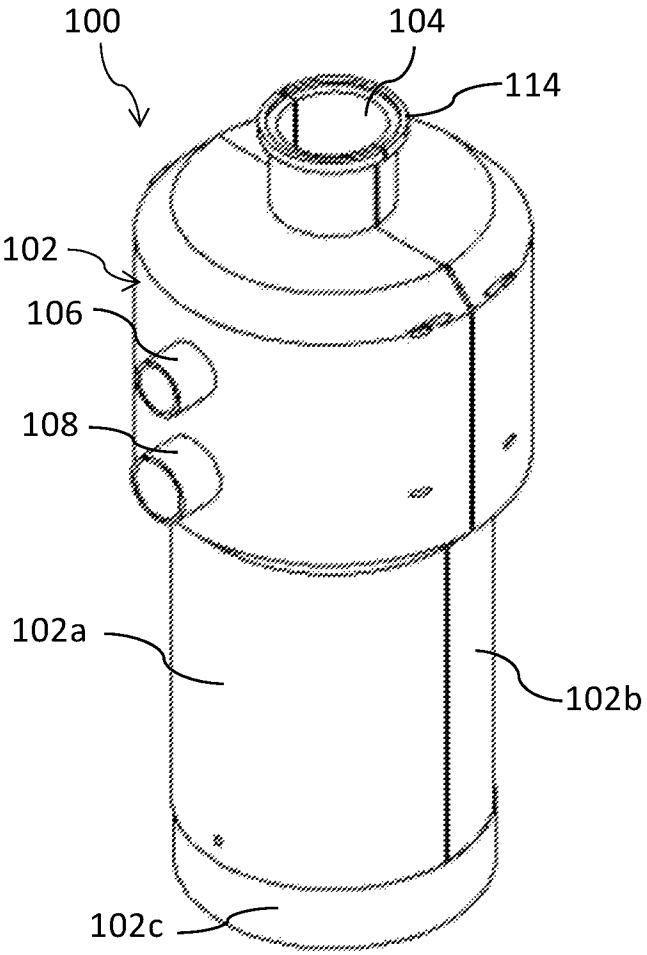
FIG. 2A constitutes a view in perspective of a waste disposer, according to some embodiments.
Figure 3B:
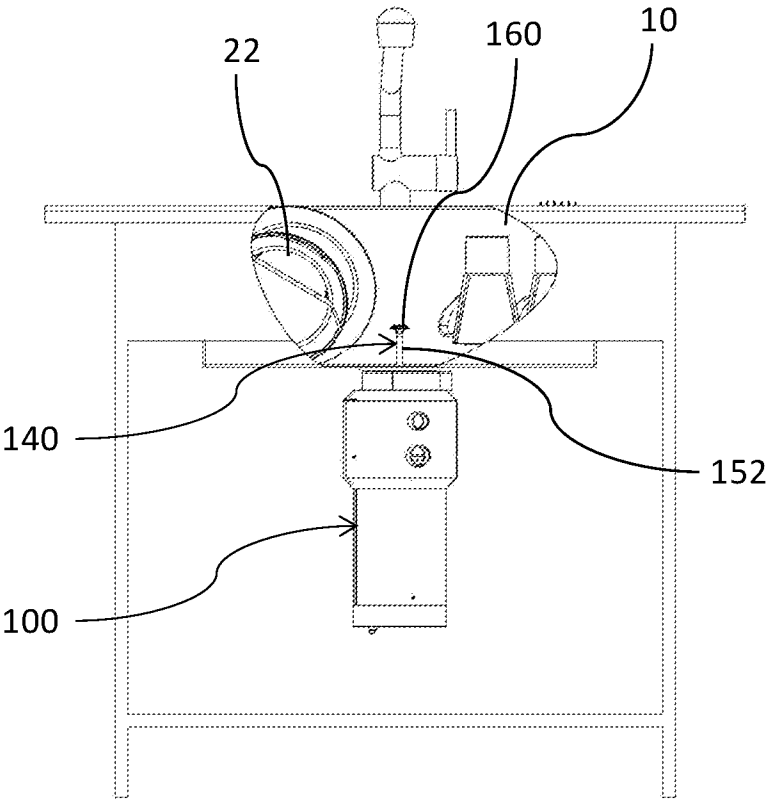
FIG. 3B constitutes a side view of a waste disposer mounted underneath a sink in a sink cabinet, with a partial cut-away showing dishes disposed within the sink, according to some embodiments.
Figure 3A:
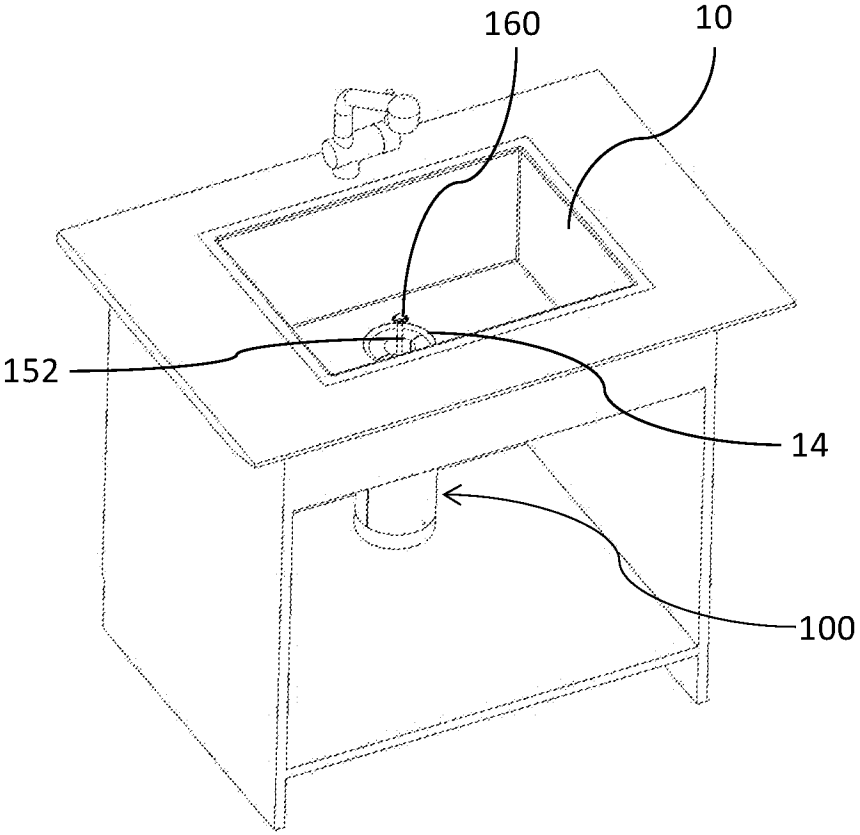
FIG. 3A constitutes a view in perspective of a waste disposer mounted underneath a sink in a sink cabinet, according to some embodiments.

According to some embodiments, housing 102 further comprises second inlet 106 (see FIG. 2A), configured for receiving water and food waste from a dishwashing machine. FIG. 2B depicts an embodiment of waste disposer 100*a* devoid of a second inlet.

According to some embodiments, motor unit 130 comprises a motor housing (not numbered) enclosing motor 134. According to some embodiments, motor 134 is a permanent magnet DC motor, a brushless DC motor, or a universal motor. Each possibility represents a separate embodiment of the present invention.

According to some embodiments, motor 134 has an outrunner or external motor configuration. Each possibility represents a separate embodiment of the present invention.

According to some embodiments, motor 134 includes a stator and a rotor extending around the outer circumference of the stator. According to some embodiments, motor 134 corresponds to any suitable type of motor that provides for an external rotor configuration.

According to some embodiments, motor 134 is configured as a brushless direct-current electric motor, a switched reluctance motor, a synchronous reluctance motor or an induction motor. Each possibility represents a separate embodiment of the present invention.

According to some embodiments, waste disposer 100 further comprises sprinkler assembly 140. According to some embodiments, sprinkler assembly 140 comprises telescoping sprinkler tube 152 mounted in a vertical slideable movement along central axis 50 within central shaft 132, connectable to a source of pressurized fluid via water inlet 110 (see FIG. 1B). According to some embodiments, water disposer 100 further comprises water inlet valve 172 disposed between sprinkler tube 152 and pressurized water inlet 110.

The terms "telescoping sprinkler tube" and "sprinkler tube", as used herein, are interchangeable, and refer to sprinkler tube 152.

The terms "pressurized water inlet" and "water inlet", as used herein, are interchangeable, and refer to water inlet 110.

According to some embodiments, motor unit 130 comprises central shaft 132, having central shaft proximal edge 136 and central shaft distal edge 138. According to some embodiments, central shaft 132 is configured to allow passage and movement of sprinkler tube 152 theretrough. According to some embodiments, central shaft 132 is integrally formed with motor unit 130. According to some embodiments, central shaft 132 is attached to an inner through-bore of motor unit 130. According to some embodiments, central shaft 132 is fully or partially disposed within an inner through-bore of motor unit 130.

According to some embodiments, motor 134 is configured to impart rotational movement to shredder plate 120. According to some embodiments, central shaft 132 is connected to shredder plate 120, and motor 134 is configured to impart rotational movement to central shaft 132, thereby rotating shredder plate 120 relative to stationary grind ring 124.

According to some embodiments, waste disposer 100 further comprises plate support 186, configured to support shredder plate 120 which is placed thereon or attached thereto. According to some embodiments, shredder plate 120 is attached to support plate 186, wherein motor 134 is configured to rotate support plate 186 around axis 50. According to some embodiments, central shaft 132 is connected to plate support 186, and motor 134 is configured to impart rotational movement to central shaft 132, thereby rotating shredder plate 120 via plate support 186.

According to some embodiments, motor 134 is configured to impart rotational movement to shredder plate 120 via magnetic force generated therebetween, instead of a shaft.

According to some embodiments, waste disposer 100 further comprises motor unit support 184, configured to support motor unit 130 which is placed thereon or attached thereto. Each possibility represents a separate embodiment of the present invention.

According to some embodiments, waste disposer 100 further comprises control circuitry 180, configured to control the operation of at least motor 134 in motor unit 130, and sprinkler tube 152. According to some embodiments, operation of sprinkler tube 152includes, but is not limited to, movement in the distal or proximal directions. According to some embodiments, operation of sprinkler tube 15 is facilitated via operation of water inlet valve 172, controlled by control circuitry 180.

According to some embodiments, control circuitry 180 is activated by a remote controller (not shown), such as a wired or wireless remote controller. Each possibility represents a separate embodiment of the present invention.

Within the context of this application, the term "proximal" generally refers to the side or end of any device or a component of a device, which is closer to sink 10 when waste disposer 100 is attached thereto, or to first inlet 104, and more specifically to mounting portion 114 of waste disposer 100.

The terms "proximal", "upper" or "top", as used herein, are interchangeable, with the exception of the expression "top position" being defined differently than the expression "upper position", as will be further elaborated hereinbelow.

Within the context of this application, the term "distal" generally refers to the side or end of any device or a component of a device, which is opposite the "proximal end", and is farther from sink 10 when waste disposer 100 is attached thereto.

The terms "distal", "lower" or "bottom", as used herein, are interchangeable.

The term "vertical direction", as used herein, refers to a direction along central axis 50.

The term "upwards", as used herein, refers to movement in a vertical direction from a distal position towards a proximal position.

The term "downwards", as used herein, refers to movement in a vertical direction from a proximal position towards a distal position.

According to some embodiments, waste disposer 100 further comprises an internal casing 182, configured to house or enclose at least one electronic component of waste disposer 100, such as control circuitry 180.

According to some embodiments, waste disposer 100 further comprises detergent valve 174, configured to introduce detergent to the water inflow flowing through water inlet 110 and to be mixed therewith and introduced into sprinkler tube 152. According to some embodiments, control circuitry 180 is configured to further control the operation of detergent valve 174.

According to some embodiments, shredder plate 120 comprises shredder plate opening 122, configured to allow passage of sprinkler tube 152 therethrough. According to some embodiments, waste disposer 100 further comprises sealing cap 162 disposed around shredder plate opening 122.

According to some embodiments, waste disposer 100 further comprises plate bearing 168, disposed between central shaft 132 and shredder plate 120, or between central shaft 132 and plate support 186 (see FIG. 4). Each possibility represents a separate embodiment of the present invention. According to some embodiments, plate bearing 168 is a roller bearing.

According to some embodiments, waste disposer 100 further comprises water inlet bearing 170, disposed around water inlet 110 distal to water inlet valve 172.

Figure 5A:
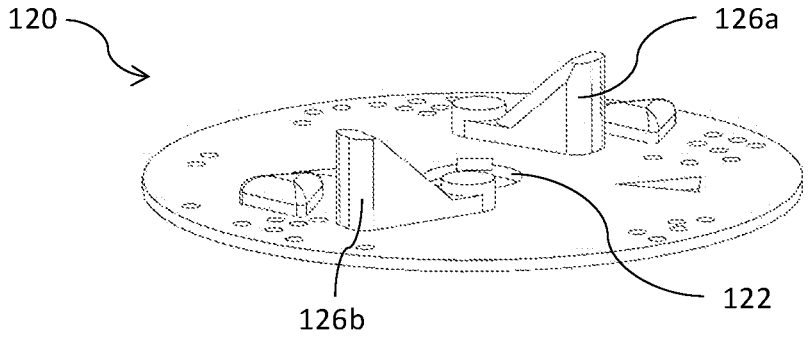
FIG. 5A constitutes a view in perspective of a shredder plate, according to some embodiments.
Figure 5B:
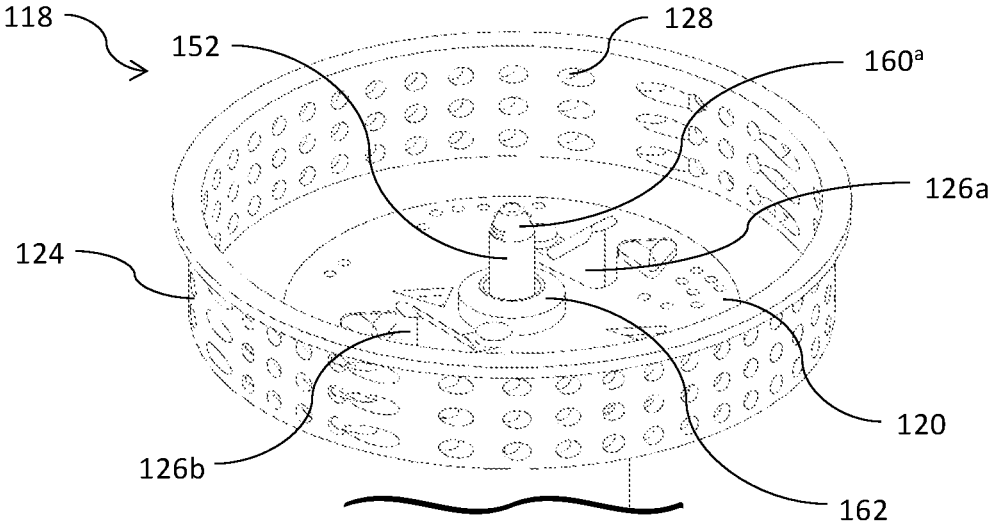
FIG. 5B constitutes a view in perspective of a grinding mechanism with a nozzle protruding through the shredder plate, according to some embodiments.
Figure 6A:
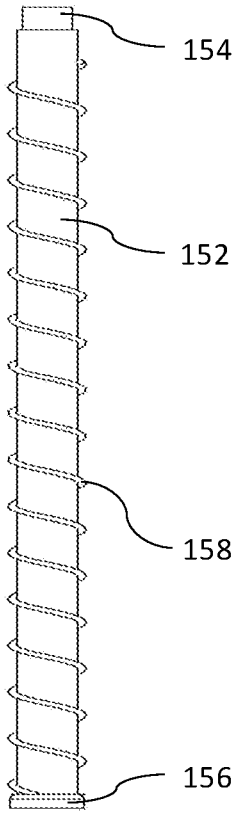
FIG. 6A constitutes a side view sprinkler tube with a spring, according to some embodiments.
Figure 6B:
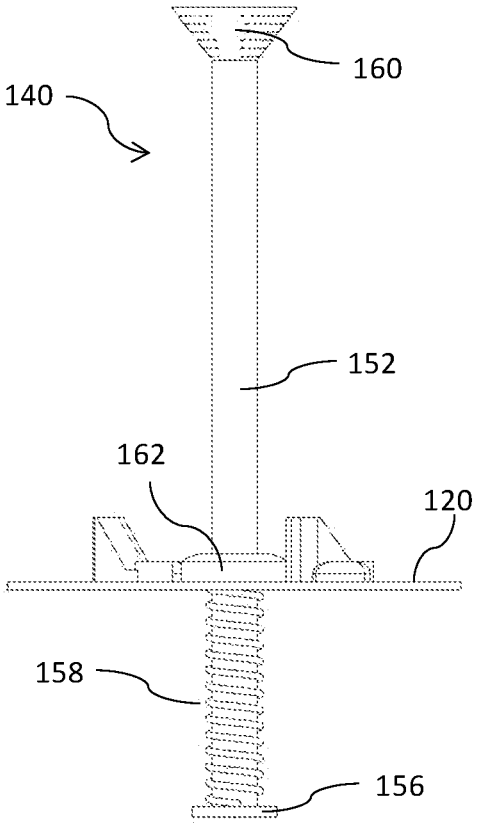
FIG. 6B constitutes a side view sprinkler tube protruding through a shredder plate, according to some embodiments.
Figure 7A:
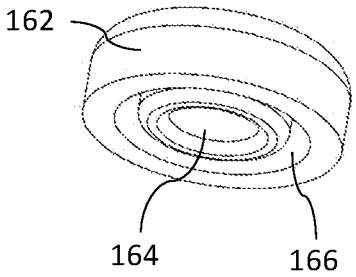
FIG. 7A constitutes a view in perspective from a bottom-side angle of a sealing cap, according to some embodiments.
Figure 7B:
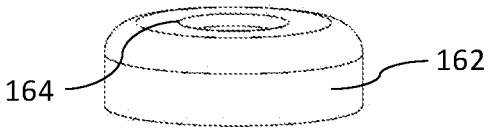
FIG. 7B constitutes a view in perspective from a top-side angle of a sealing cap, according to some embodiments.
Figure 7C:
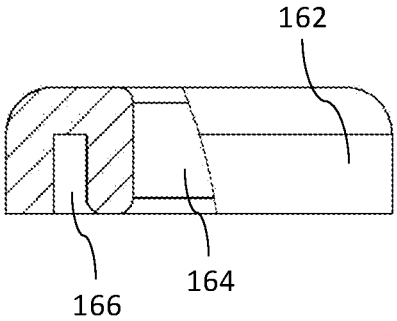
FIG. 7C constitutes a partial cut-away side view of a sealing cap, according to some embodiments FIG. 8A constitutes a sectional view in perspective of a waste disposer in a bottom position of a sprinkler assembly, according to some embodiments.

Reference is now made to FIGS. 5A-7C. FIG. 5A constitutes a view in perspective of a shredder plate 120, according to some embodiments. FIGS. 5B-5C constitute views in perspective of a grinding mechanism 118 having a sprinkler tube 152 with nozzle head 160*a* and 160*b*, respectively, protruding there through. FIG. 6A constitutes a view in perspective of a sprinkler tube 152, according to some embodiments. FIG. 6A constitutes a view in perspective of sprinkler tube 152 protruding through shredder plate 120, according to some embodiments. FIGS. 7A-7C constitute a view in perspective from a down-side angle, a view in perspective from a top-side angle, and a partial cut-away side view of a sealing cap 162, according to some embodiments.

According to some embodiments, sprinkler tube 152 comprises sprinkler tube proximal end 154 and sprinkler tube distal end 156. According to some embodiments, sprinkler tube distal end 156 is formed as a flange (see FIG. 6A). According to some embodiments, sprinkler assembly 140 further comprises a nozzle head 160 connected or to sprinkler tube proximal end 154, configured for discharging water therefrom.

Sprinkler assembly 140 further comprises spring 158 extending between sprinkler tube distal end or flange 156 and shredder plate 120 (see FIG. 6B). According to some embodiments, spring 158 extends between flange 156 and plate support 186.

According to some embodiments, sealing cap 162 comprises cap opening 164, configured to allow passage of sprinkler tube 152 there through. According to some embodiments, sealing cap 162 is formed as an annular body disposed over shredder plate opening 122, and is configured to seal the gap between the edges of plate opening 122 and sprinkle tube 152 from leaking water.

According to some embodiments, sealing cap 162 comprises groove 166, such as inverted U-shaped groove 166 depicted in FIG. 7C, extending around the underside of the annular body of sealing cap 162, configured to attach to at least one corresponding protrusion (not numbered) extending from shredder plate 120.

According to some embodiments, sealing cap 162 is configured to prevent fluid or waste from entering from an inner volume of grinding mechanism 118 to any one of motor unit 130 and central shaft 132 or their surrounding. According to some embodiments, sealing cap 162 is configured to prevent pressurized water from entering from the volume bound between central shaft 132 and sprinkler tube 152 to the surrounding of grinding mechanism 118.

According to some embodiments, shredder plate 120 further comprises at least one surface feature 126, and preferably a plurality of surface features such as 126*a* and 126*b* (see FIG. 5A), extending upwardly therefrom. According to some embodiments, each of surface feature 126 includes, but is not limited to, lugs, blades or fins. According to some embodiments, shredder plate 120 comprises a plurality of surface feature 126 of different forms.

According to some embodiments, stationary grind ring 124 comprises a plurality of stationary grind aperture 128, circumferentially disposed therearound. According to some embodiments, each stationary grind aperture 128 is surrounded by cutting edges configured to grind, shred, cut and/or otherwise process the waste. Each possibility represents a separate embodiment of the present invention.

According to some embodiments, stationary grind ring 124 is affixed, directly or indirectly, to housing 102, and is configured to be stationary with respect to shredder plate 120.

During operation of waste disposer 100, waste and water are directed towards grinding mechanism 118. Waste and water can be received from first inlet 104, from second inlet 106, or from both. Shredder plate 120 is rotated by motor 134 upon operation of waste disposer 100. Due to the rotation of shredder plate 120, one or more surface feature 126 forces the waste, such as food waste, against stationary grind ring 124 towards stationary ring apertures 128 to grind the food waste into small particulate matter, also referred to as 'processed waste'. The processed waste is subsequently discharged, via outlet 108, towards a drain line (not shown).

Figure 5C:
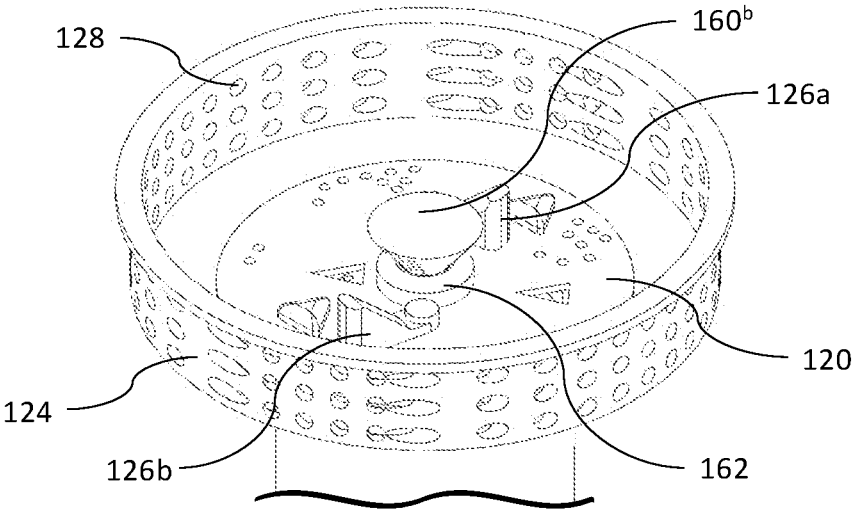
FIG. 5C constitutes a view in perspective of a grinding mechanism with a nozzle protruding through the shredder plate, according to some embodiments.

According to some embodiments, nozzle cap 160 may be of different geometrical forms, shapes and sizes, such as conical or frustoconical nozzle cap 160*a* (see FIG. 5B) or inverted frustoconical nozzle cap 160*b*(see FIG. 5C). Each possibility represents a separate embodiment of the present invention.

According to some embodiments, nozzle cap 160 is integrally formed with sprinkler tube 152. According to some embodiments, nozzle cap 160 is removably attached to sprinkler tube proximal end 154.

Figure 8A:
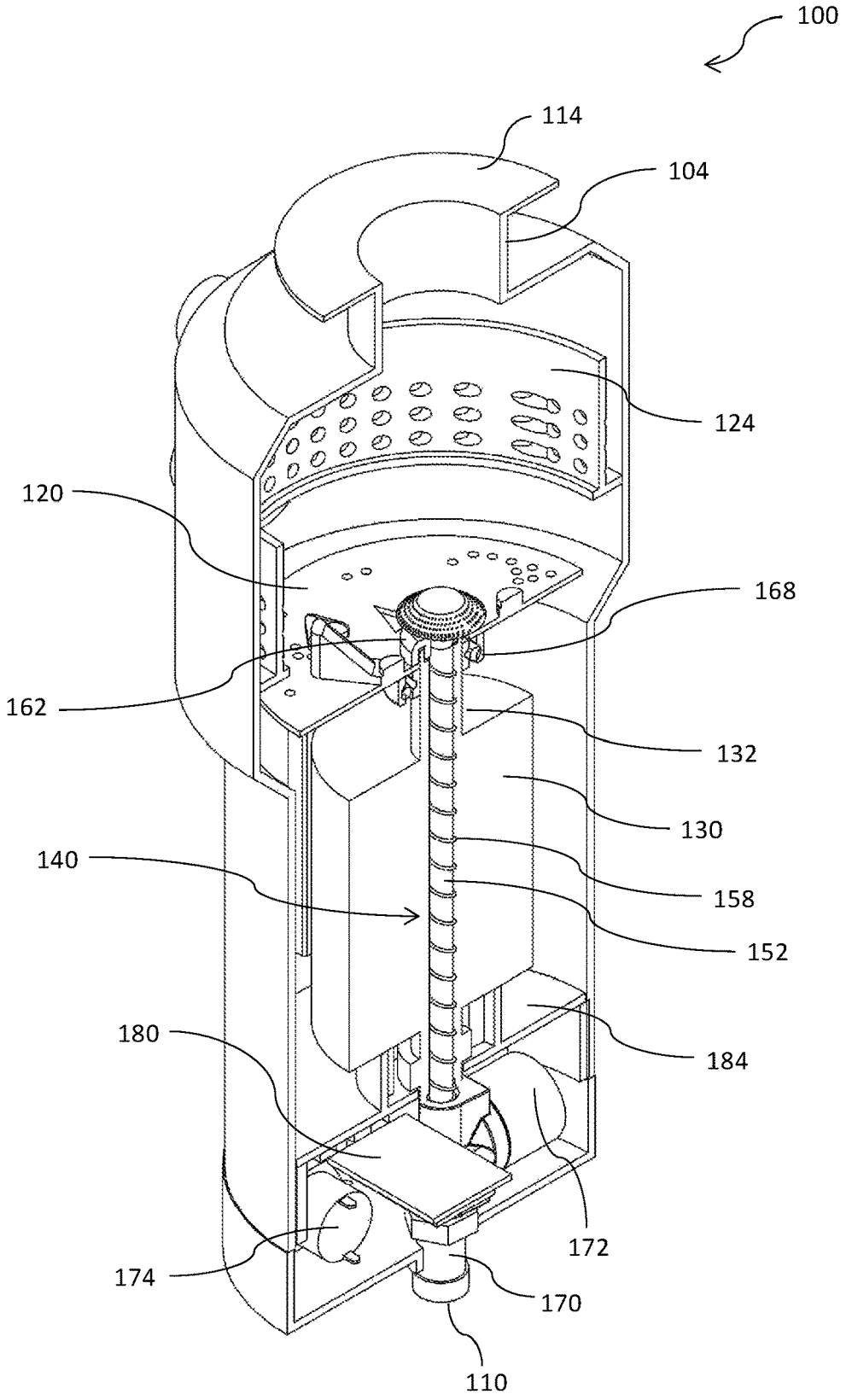
FIG. 8B constitutes a sectional view in perspective of a waste disposer in an intermediate position of a sprinkler assembly, according to some embodiments.
FIG. 8C constitutes a sectional view in perspective of a waste disposer in a top position of a sprinkler assembly, according to some embodiments.
Figure 8B:
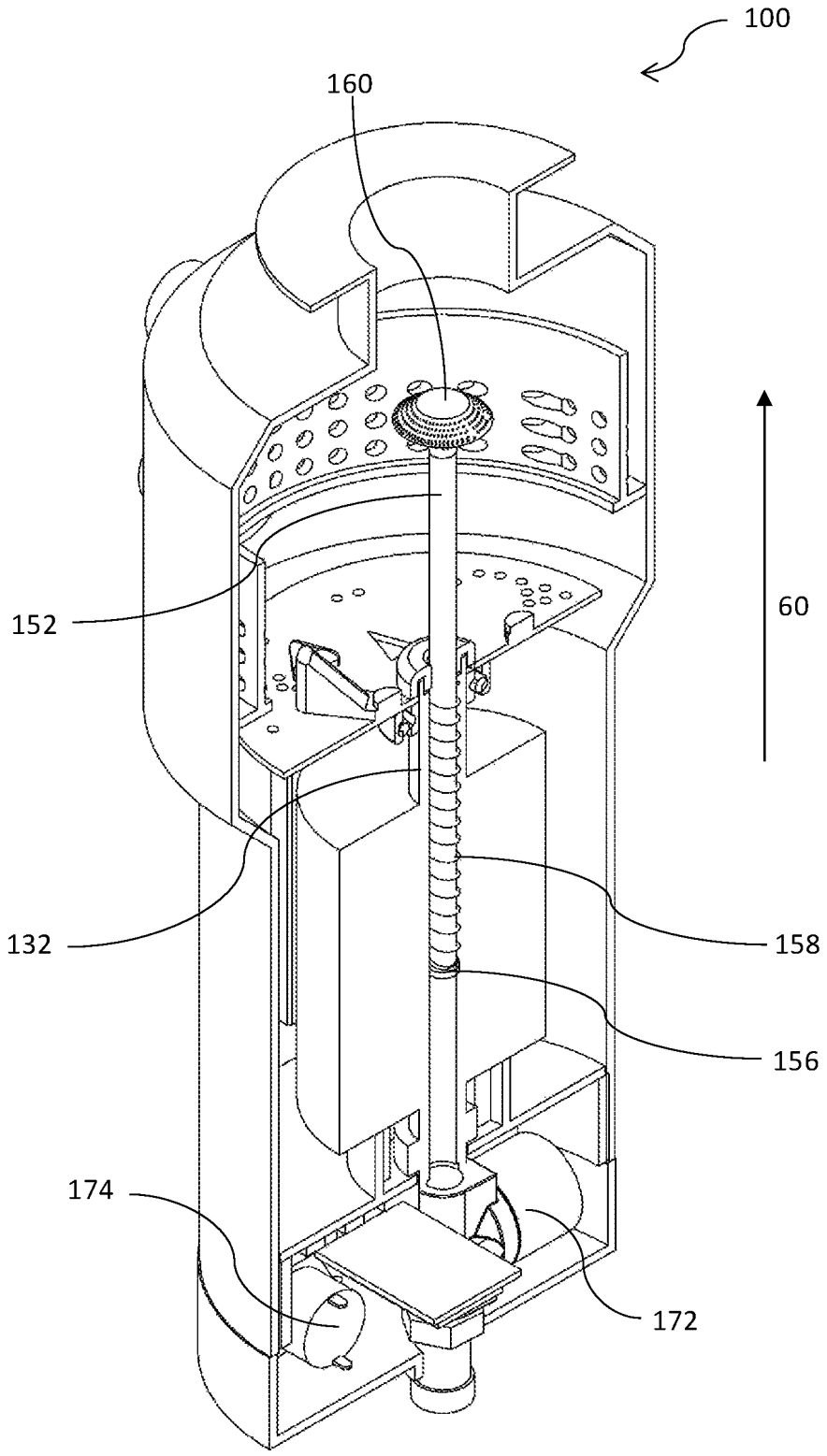
Figure 8C:
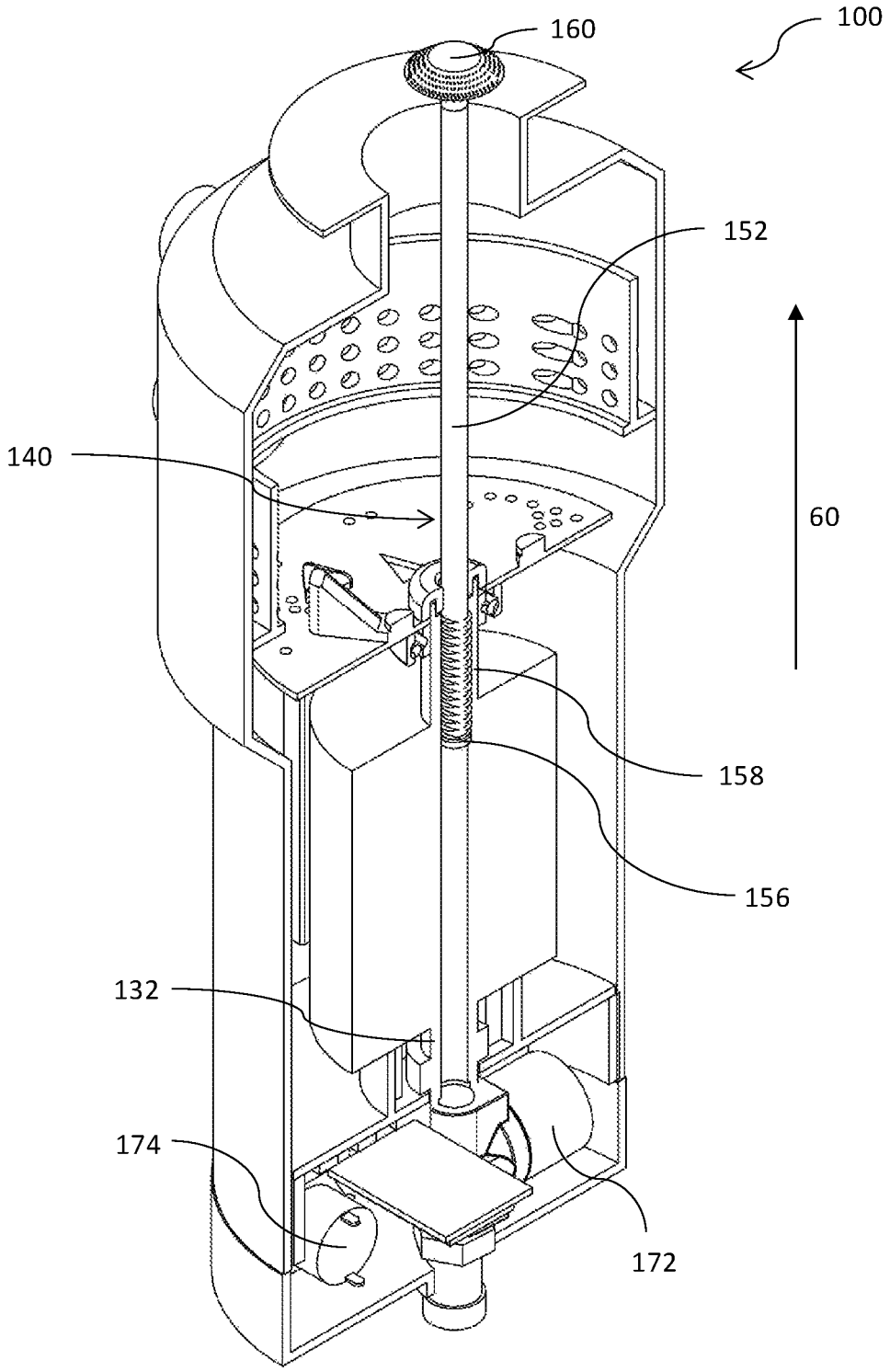

Reference is now made to FIGS. 8A-8C. FIGS. 8A-8C constitute sectional views in perspective of waste disposer 100 having sprinkler assembly 140 positioned at different positions during operation thereof. Sprinkler assembly 140 is moveable between a bottom position and an upper position. A bottom position of sprinkler assembly 140 is shown in FIG. 8A, wherein sprinkler tube distal end 156 is biased by spring 158 to its most distal position, for example to rest against motor unit support 184.

During operation of waste disposer 100, control circuitry 180 operates water inlet valve 172 so as to allow pressurized water from water inlet 110 to enter in the direction of arrow 60. The pressurized water impacts sprinkler tube distal end or flange 156, forcibly urging sprinkler tube 152, along nozzle head 160 upwards, in the direction of arrow 60, through a series of intermediate positions such as an intermediate position depicted in FIG. 8B, towards an upper position or a top position depicted in FIG. 8C.

The upward movement of sprinkler tube 152 is against the expansion pressure of spring 158. Thus, when pressurized water is reduced or shut-off, for example by closing water inlet valve 172, compressed spring 158 expands and forces sprinkler tube distal end or flange 156 downwards in a direction opposite to arrow 60, back to a bottom position.

An intermediate position of sprinkler assembly 140 is any position in which nozzle head 160 is higher than its bottom position, but lower than the level of sink drain 14 when waste disposer 100 is mounted below sink 10. An upper position is any position in which nozzle head 160 is above the level of sink drain 14. A top position is a specific case of an upper position, such that sprinkler assembly 140 is unable to move further upwards in the direction of arrow 60.

According to some embodiments, control circuitry 180 defines different upper positions in different situations, thereby controlling the height of nozzle head 160 during operation of waste disposer 100.

It will be clear to persons skilled in the art that other structural assemblies of sprinkler assembly 140 are available, configured to allow movement thereof from a bottom position upwards when subjected to pressurized water. For example, while spring 158 is shown throughout the figures to be disposed around the outer circumferential surface (not numbered) of sprinkler tube 152, according to some embodiments, spring 158 is disposed within the inner lumen (not numbered) of sprinkler tube 152. While sprinkler tube distal end 156 is shown throughout the figures as a flange extending radially outwards, according to some embodiments, sprinkler tube distal end 156 is formed as a flange extending radially inwards, towards the central axis 50 (embodiment not shown). Similarly, a flange against which pressurized water act to urge sprinkler assembly 140 upwards may be disposed around other portions of sprinkler tube 152, for example at a location higher that sprinkler tube distal end 156, radially extending either outwards or inwards (embodiments not shown). According to some embodiments, at least one end of spring 158 is attached to sprinkler tube 152, such as a distal end (not numbered) of spring 158 being attached to sprinkler tube distal end 156. According to some embodiments, the distal end of spring 158 abuts a flanged sprinkler tube distal end 156 without being rigidly attached thereto.

According to some embodiments, sprinkler assembly is electrically connected to control circuitry 180, and is configured to move between bottom and upper positions via an electric actuation mechanism as known in the art.

Figure 9C:
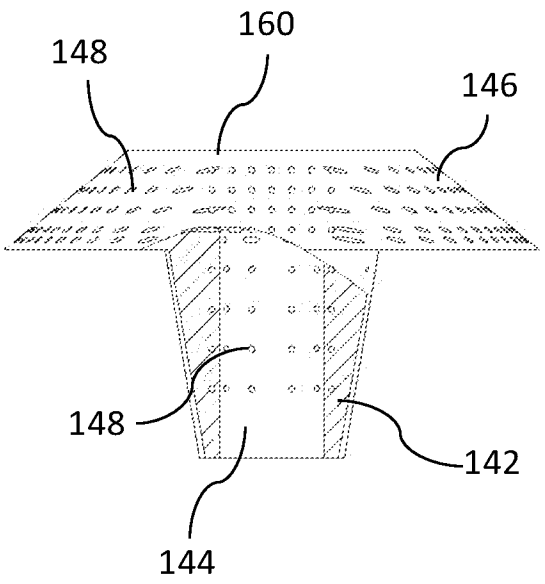
FIG. 9C constitutes a partial cut-away side view of a nozzle, according to some embodiments.
Figure 9B:
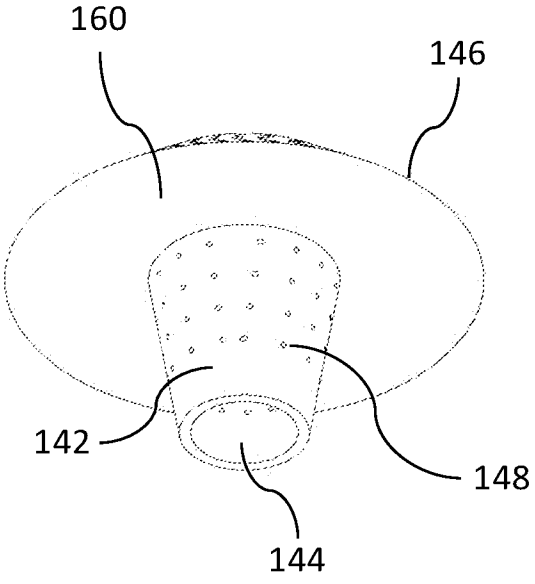
FIG. 9B constitutes a view in perspective from a bottom-side angle of a nozzle, according to some embodiments.
Figure 9A:
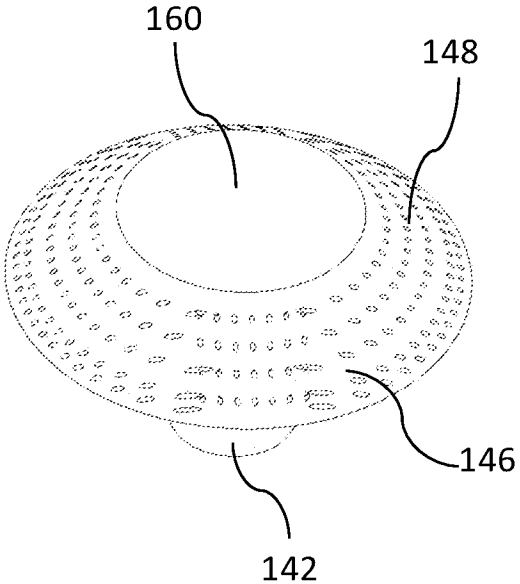
FIG. 9A constitutes a view in perspective from a top-side angle of a nozzle, according to some embodiments.

Reference is now made to FIGS. 9A-11C, depicting different types of nozzle head 160. FIGS. 9A-9C constitute a top-side view in perspective, a bottom-side view in perspective, and a partial sectional side view, respectively, of an exemplary embodiment of nozzle head 160. Nozzle head 160 comprises a nozzle proximal section 146 and a nozzle distal section 142. Nozzle distal section comprises a nozzle receiving bore 144, to receive sprinkler tube proximal end 154 therein.

According to some embodiments, nozzle head 160 is attached to sprinkler tube proximal end 154 by press-fitting, such that the diameter of nozzle receiving bore 144 is adapted to press-fit with sprinkler tube proximal end 154.

According to some embodiments, nozzle head 160 is held by friction-fit against sprinkler tube proximal end 154. According to some embodiments, the inner surface of nozzle receiving bore 144 is configured to provide friction force against the surface of sprinkler tube proximal end 154 at a magnitude sufficient to prevent relative movement there between.

According to some embodiments, nozzle head 160 is threadedly attached to sprinkler tube proximal end 154, whereby nozzle receiving bore 144 comprises outer screw-threads matching inner screw-threads of sprinkler tube proximal end 154, or alternatively nozzle receiving bore 144 comprises inner screw-threads matching outer screw-threads of sprinkler tube proximal end 154.

According to some embodiments, nozzle head 160 further comprises a plurality of orifices, such as nozzle apertures 148 or nozzle slots 150. According to some embodiments, sprinkler assembly 140 is configured to allow water emitted from sprinkler tube 152 and flowing into nozzle receiving bore 144 to go through ports leading to such orifices, thereby producing water jets in the directions dictated by the orifices.

According to some embodiments, nozzle proximal section 146 comprises a plurality of nozzle apertures 148, distributed along its circumference.

According to some embodiments, nozzle distal section 142 comprises a plurality of nozzle apertures 148, distributed along its circumference.

According to some embodiments, both nozzle proximal section 146 and nozzle distal section 142 comprise a plurality of nozzle apertures 148 along their respective circumferential surfaces (see FIG. 9A-9C).

Figure 10C:
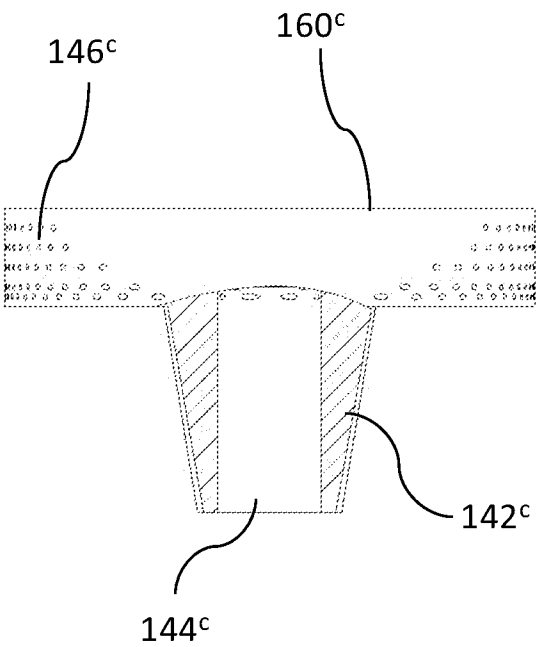
FIG. 10C constitutes a partial cut-away side view of a nozzle, according to some embodiments.
Figure 10B:
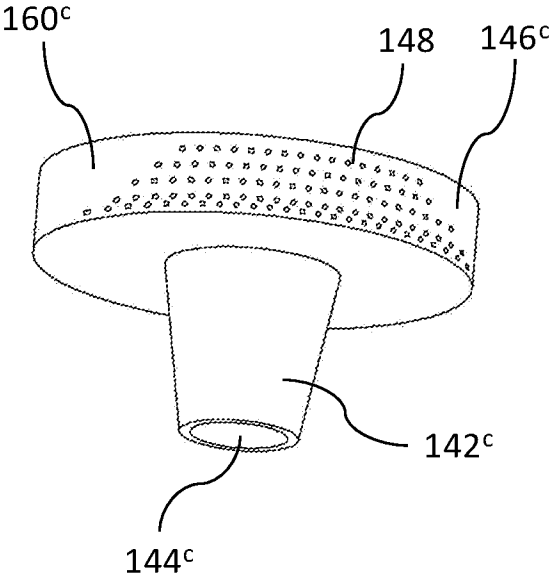
FIG. 10B constitutes a view in perspective from a bottom-side angle of a nozzle, according to some embodiments.
Figure 10A:
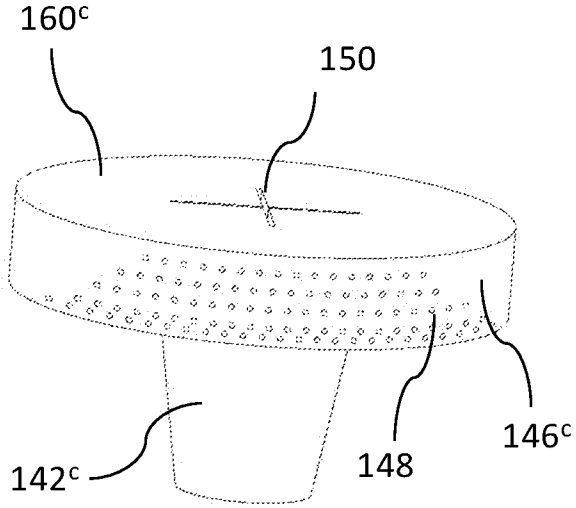
FIG. 10A constitutes a view in perspective from a top-side angle of a nozzle, according to some embodiments.

FIGS. 10A-10C constitute a top-side view in perspective, a bottom-side view in perspective, and a partial sectional side view, respectively, of an exemplary embodiment of nozzle head 160. Nozzle head 160*c* comprises a nozzle distal section 142*c* and a nozzle proximal section 146.

According to some embodiments, nozzle proximal section 146*c* comprises nozzle slots 150. According to some embodiments, nozzle proximal section 146*c* comprises both nozzle apertures 148 along its circumference and nozzle slots 150 along a top surface thereof (see FIGS. 10A-10C).

FIGS. 10A-10C constitute a top-side view in perspective, a bottom-side view in perspective, and a partial sectional side view, respectively, of an exemplary embodiment of nozzle head 160$^d$.

According to some embodiments, nozzle distal section 142, such as nozzle distal section 142$^d$, comprises a plurality of nozzle distal sub-sections. According to some embodiments, nozzle head 160$^d$ comprises nozzle distal section 142$^d$, first nozzle proximal sub-section 146$^d$*a* and second nozzle distal sub-section 146$^d$*b*.

According to some embodiments, first nozzle proximal sub-section 146*a*$^d$ comprises a plurality of nozzle apertures 148, distributed along its circumference.

Figure 11C:
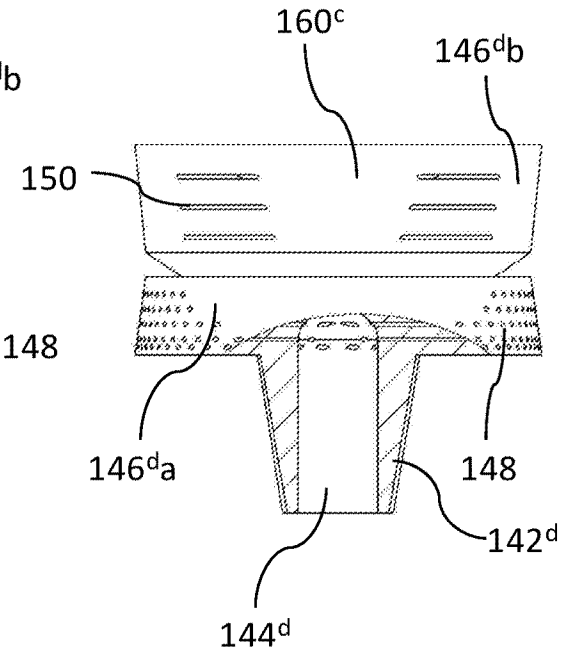
FIG. 11C constitutes a partial cut-away side view of a nozzle, according to some embodiments.
Figure 11B:
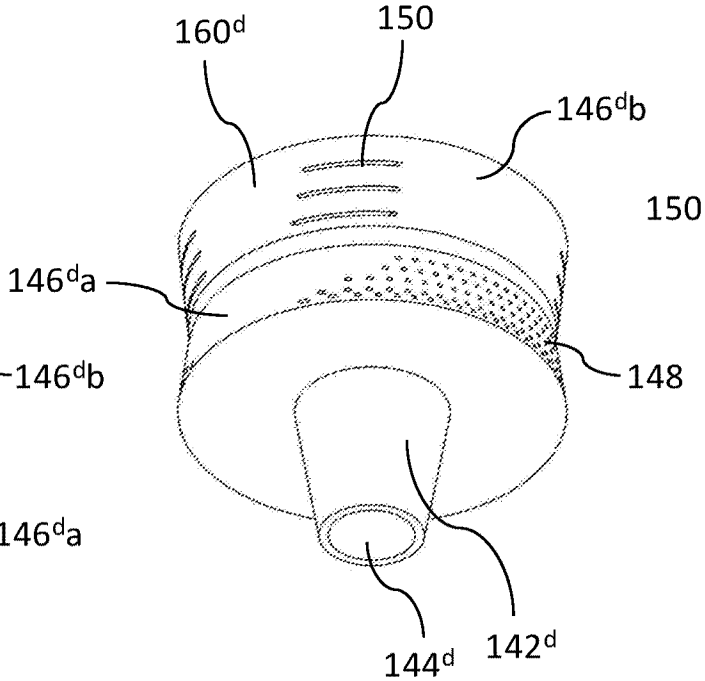
FIG. 11B constitutes a view in perspective from a bottom-side angle of a nozzle, according to some embodiments.
Figure 11A:
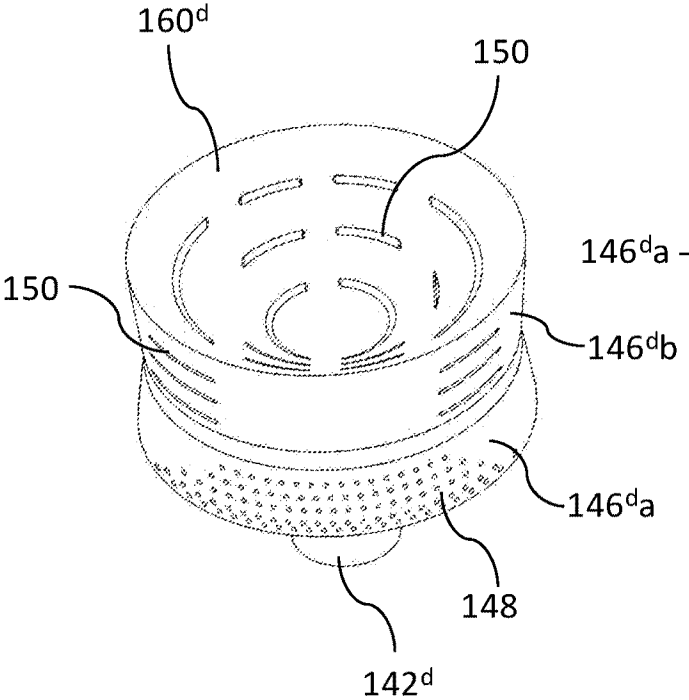
FIG. 11A constitutes a view in perspective from a top-side angle of a nozzle, according to some embodiments.

According to some embodiments, second nozzle distal sub-section 146*b*$^d$ comprises a plurality of nozzle slots 150, for example both along its circumference and its upper surface (see FIGS. 11A-11C).

According to some embodiments, the outer surface of nozzle distal section 142 is formed with an inverted frustoconical shape (see FIGS. 9A-11C). According to some embodiments, nozzle proximal section or sub-section 160 is frustoconical (see nozzle proximal section 146 in FIGS. 9A-9C). According to some embodiments, nozzle proximal section or sub-section 146 is cylindrical (see nozzle proximal section 146*c* in FIGS. 10A-10C). According to some embodiments, nozzle proximal section or sub-section 146 comprises a concave top surface (see nozzle proximal section 146$^d$*b* in FIGS. 10A-10C).

It will be appreciated by persons skilled in the art that nozzle heads of other designs may be utilized and attached to sprinkler tube proximal end 154. Advantageously, removable attachment between nozzle head 160 and sprinkler tube proximal end 154 facilitates, according to some embodiments, replacement or substitution of various nozzle heads 160 to provide different water discharge characteristics, trajectories, and so forth.

Reference in now made to FIGS. 12A-12D, depicting different exemplary profiles of water jets emitted from nozzle head 160, according to some embodiments. The orifices of nozzle head 160 are disposed so as to provide water jets for washing the interior space of sink 10, which may hit, for example, the internal walls of sink 10 or dishes 22 placed therein (see FIG. 3B).

Advantageously, the water jets can serve both for rinsing and washing dishes, such as plates and glasses, placed in sink 10, or wash the internal walls and bottom surface of sink 10, and carry unneeded waste or scraps to sink drain 14, from which the waste ultimately enters through first inlet 104 into the grinding mechanism 118 of waste disposer 100.

Figure 12A:
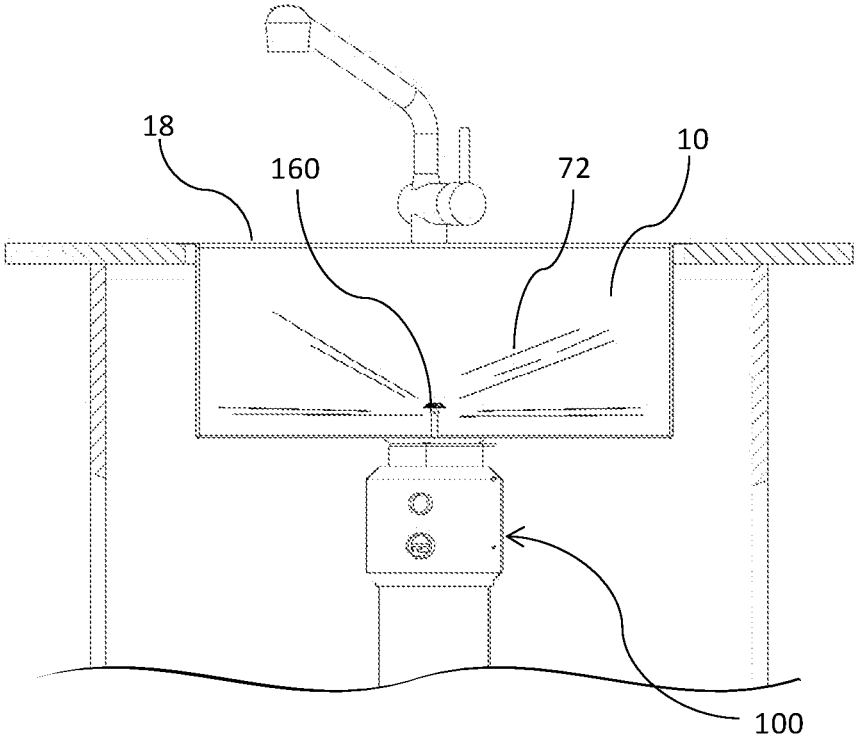
FIG. 12A constitutes a partial cut-away side view of a waste disposer mounted underneath a sink, showing flow lines of water flowing through a nozzle positioned in a proximal-end position, according to some embodiments.

FIG. 12A depicts waste disposer 100 mounted under sink 10, wherein nozzle head 160 of the type depicted in FIGS. 9A-9C, operating in an upper position, provides water jets 72 which are emitted from nozzle apertures 148 of nozzle distal section 142, at substantially horizontal directions, as well as water jets 72 which are emitted from nozzle apertures 148 of nozzle proximal section 146, angled upwards relative to a horizontal plane.

The term "horizontal plane", as used herein, is a plane perpendicular to the vertical direction.

According to some embodiments, the bottom surface of sink 10 is in a horizontal plane.

The term "horizontal direction", as used herein, refers to any direction along a horizontal plane.

The term "substantially horizontal direction", as used herein, refers to either a horizontal direction or a direction angled relative to a horizontal plane, at an angle which is not higher than 15 degrees.

According to some embodiments, orifices 148, 150 of nozzle head 160 are configured so as to create jet streams oriented such that the water and waste gathered at the bottom of sink 10 are introduced into first inlet 104 at a spiraling flow-path.

According to some embodiments, cover 18 is provided to fluidly seal sink 10 from a top thereof, thereby preventing water jets 72 from splattering outside the boundaries of the inner space of sink 10. According to some embodiments, cover 18 is formed as a shutter.

Figure 12B:
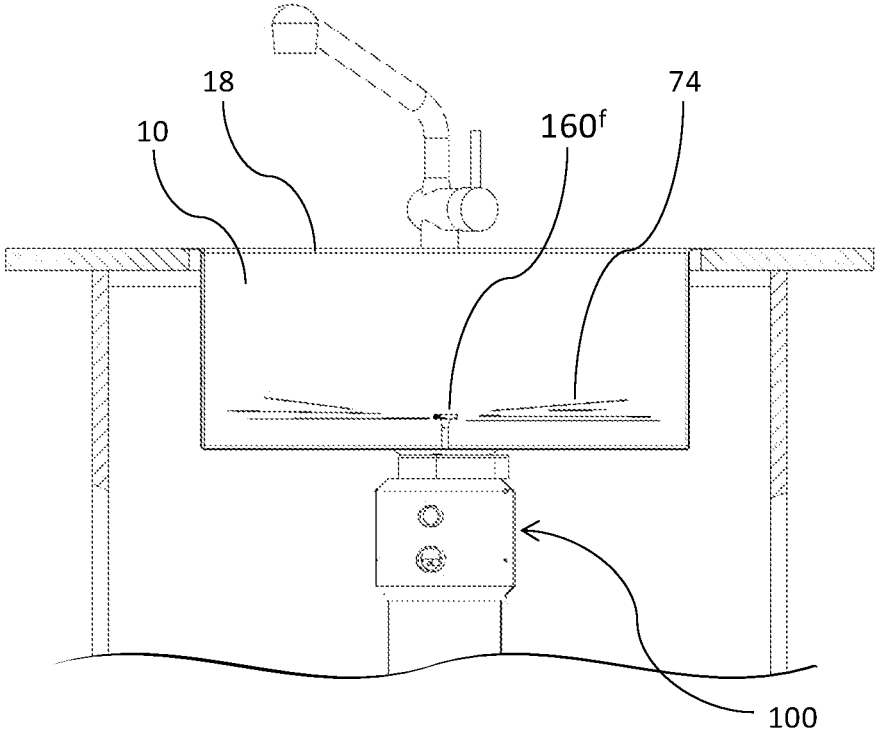
FIG. 12B constitutes a partial cut-away side view of a waste disposer mounted underneath a sink, showing flow lines of water flowing through a nozzle positioned in a proximal-end position, according to some embodiments.

FIG. 12B depicts waste disposer 100 having a nozzle head 160*c* of the type depicted in FIGS. 10A-10C, wherein water jets 74 are emitted from nozzle apertures 148 of nozzle proximal section 146, at substantially horizontal directions, and potentially also jet streams angled upwards relative to a horizontal plane.

Figure 12C:
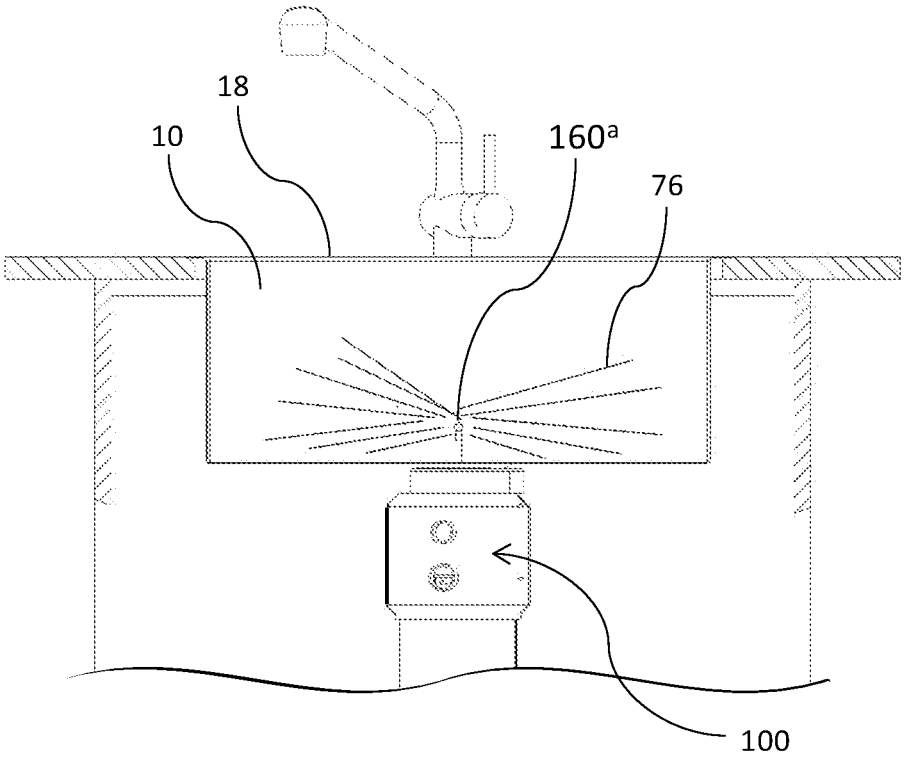
FIG. 12C constitutes a partial cut-away side view of a waste disposer mounted underneath a sink, showing flow lines of water flowing through a nozzle positioned in a proximal-end position, according to some embodiments.

FIG. 12C depicts waste disposer 100 having nozzle head 160*a* of the type depicted in FIG. 5C, wherein water jets 76 are emitted from nozzle apertures 148 nozzle head 160*a*, at either substantially horizontal directions, as well as jet streams angled upwards and downwards relative to a horizontal plane.

Figure 12D:
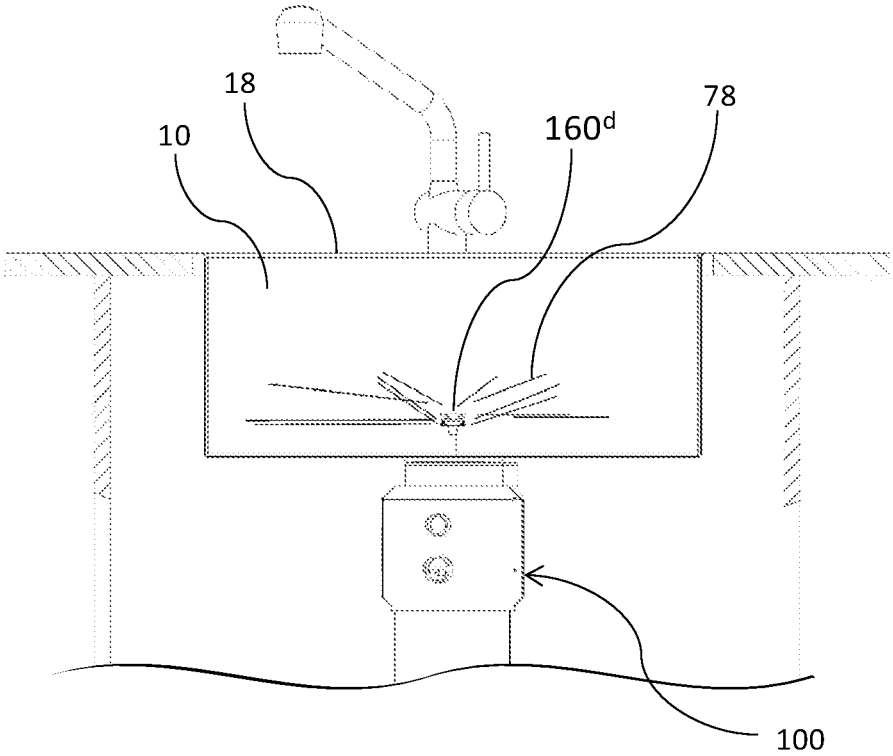
FIG. 12D constitutes a partial cut-away side view of a waste disposer mounted underneath a sink, showing flow lines of water flowing through a nozzle positioned in a proximal-end position, according to some embodiments.

FIG. 12D depicts waste disposer 100 having nozzle head 160$^d$ of the type depicted in FIGS. 11A-11C, wherein water jets 78 are emitted from nozzle apertures 148 and nozzle slots 150 of nozzle proximal sub-sections 146$^d$*a*, 146$^d$*b*, at substantially horizontal directions, as well as jet streams angled upwards relative to a horizontal plane.

Surprisingly, an orifice diameter of about 0.3 mm was found to produce water jets with sufficient force to remove waste products attached to dishes or to sidewalls of a sink. Advantageously, such configuration allow use of a minimum amount of water. According to some embodiments, nozzle head 160 comprises a plurality of nozzle apertures 148 with a diameter of 0.2-5 millimeters. According to some embodiments, nozzle head 160 comprises a plurality of nozzle apertures 148 with a diameter of 0.2-1 millimeters. According to some embodiments, nozzle head 160 comprises a plurality of nozzle apertures 148 with a diameter of 0.2-0.4 millimeters. According to some embodiments, nozzle head 160 comprises a plurality of nozzle apertures 148 with a diameter of 0.25-0.35 millimeters. According to some embodiments, nozzle head 160 comprises a plurality of nozzle apertures with varying diameters.

According to some embodiments, sink 10 is formed as a sink incorporating dishwasher functionalities (embodiments not shown), such that waste disposer 100 is configured to attach or be part of a sink having such functionalities, whereby sprinkler assembly 140 is configured to eject fluid jets towards dishes 22 within such a sink, while waste is directed through sink drain 14 into grinding mechanism 118.

Similarly, according to some embodiments, sink 10 includes a dishwashing apparatus attached thereto or disposed therein, such that waste disposer 100 is configured to attach to the dishwashing apparatus, whereby sprinkler assembly 140 is configured to eject fluid jets towards dishes 22 within the dishwashing apparatus, while waste is directed from the dishwashing apparatus into grinding mechanism 118.

According to some embodiments, nozzle head 160 is rotateably connected to sprinkler tube 152, for example via a bearing such as a flat bearing or a ball bearing (embodiment not shown), such that nozzle head 160 is configured to rotate about central axis 50 thereby providing water jets circulating around sink 10 when waste disposer 100 is mounted thereto.

According to some embodiments, nozzle head 160 is equipped with at least one water deflector (not shown) causing rotation of nozzle head 160 when impacted by pressurized water from sprinkler tube 152.

According to some embodiments, at least some of orifices 148, 150 of nozzle head 160 are oriented in such a manner, that jet streams passing there through exert a tangential force on nozzle head 160 so as to impart rotational movement thereof.

Figure 13A:
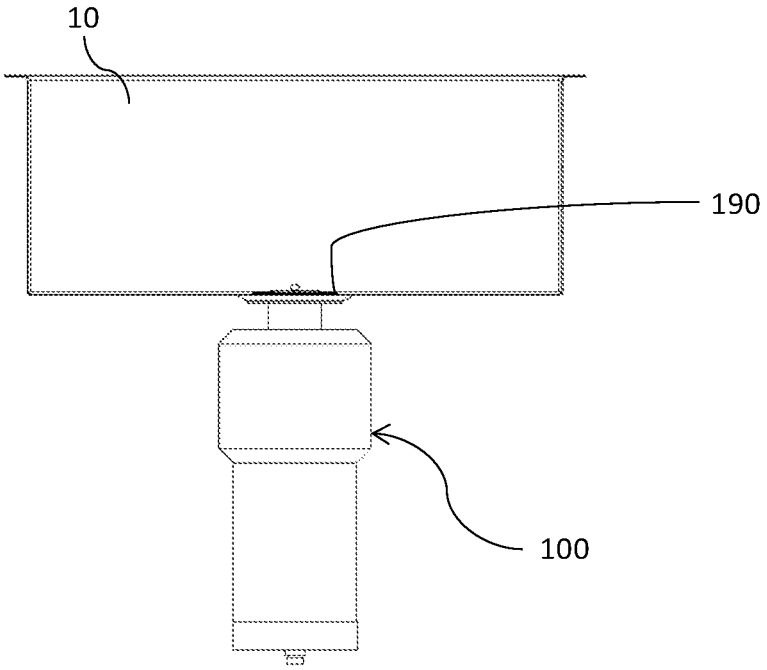
FIG. 13A constitutes a side view of a waste disposer mounted underneath a sink, having a strainer in a distal-end position, according to some embodiments.
Figure 13B:
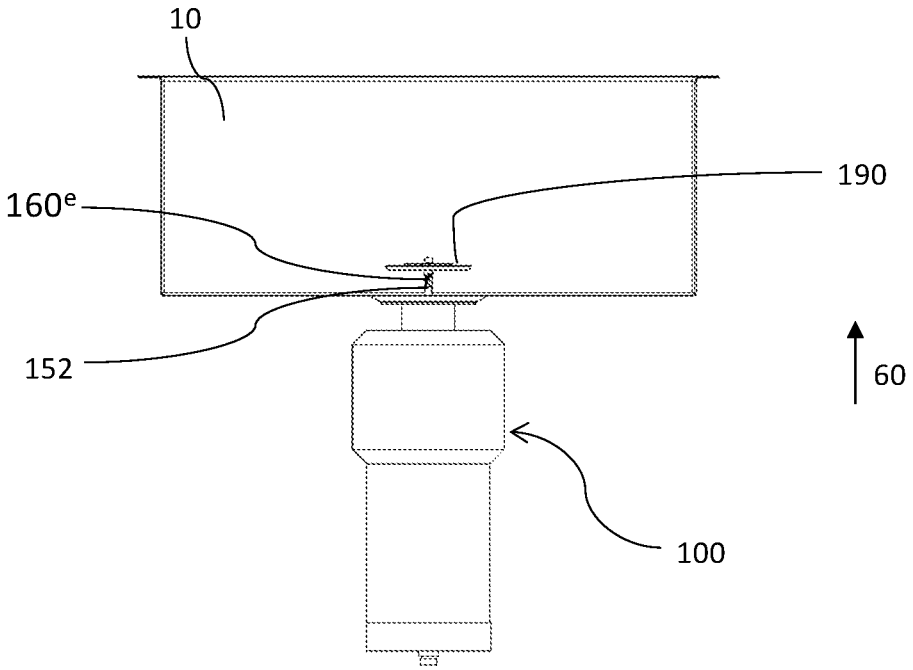
FIG. 13B constitutes a side view of a waste disposer mounted underneath a sink, having a strainer in a proximal-end position, according to some embodiments.
Figure 14A:
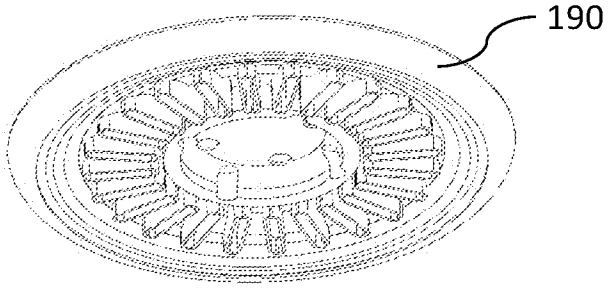
FIG. 14A constitutes a view in perspective from a bottom-side angle of a strainer, according to some embodiments.
Figure 14B:
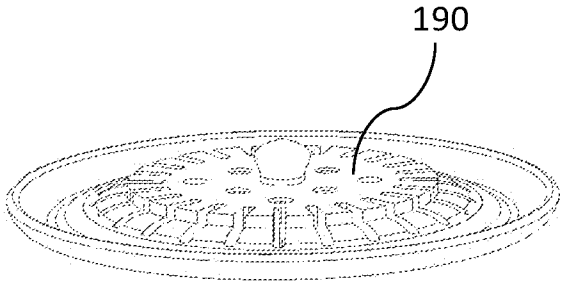
FIG. 14B constitutes a view in perspective from a top-side angle of a strainer, according to some embodiments.

Reference in now made to FIGS. 13A-14B. FIGS. 13A-13B constitute side-views of a waste disposer 100 equipped with a strainer 190 in a bottom and an upper position, respectively. FIG. 13C constitutes a view in perspective of the waste disposer 100 and strainer 190 depicted in FIG. 13B. FIGS. 14A-14B constitute a bottom-side and a top-side views in perspective, respectively, of strainer 190.

According to some embodiments, waste disposer 100 further comprises strainer 190, configured to attach to a distal end of nozzle head 160. Advantageously, strainer 190 may serve as a protection means preventing foreign objects, including a user's hands or fingers, from entering through first inlet 104 and either damaging a component of waste disposer 100, or be damaged thereby.

FIG. 13A depicts a bottom position in which strainer 190 abuts the rim of sink drain 14.

Figure 13C:
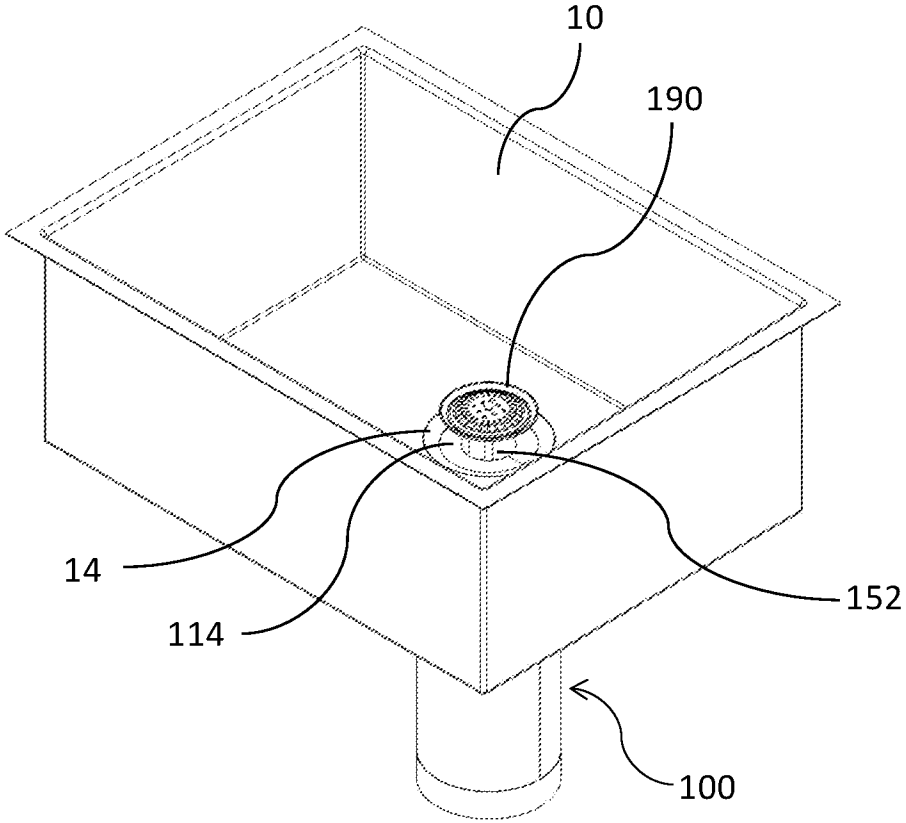
FIG. 13C constitutes a view in perspective of a waste disposer mounted underneath a sink, having a strainer in a proximal-end position, according to some embodiments.

FIGS. 13B-13C depict an upper or top position in which strainer 190 is moved upwards in the direction of arrow 60, thereby exposing sink drain 14 and allowing passage of water and waste from sink 10 through first inlet 104.

According to some embodiments, nozzle head 160e (see FIG. 13B) comprises a plurality of nozzle apertures 148 disposed about its circumference, below the level of strainer 190.

According to some embodiments, strainer 190 is removably attached to nozzle head 160. According to some embodiments, strainer 190 is press-fit against nozzle head 160, enabling removal thereof by applying pull-force by hand. According to some embodiments, strainer 190 is threadedly attached to nozzle head 160. According to some embodiments, strainer 190 is magnetically attached to nozzle head 160, for example via magnetic force emanating from a magnet embedded within nozzle head 160 (not shown), acting against a metal or another magnet embedded within strainer 190.

Figure 15A:
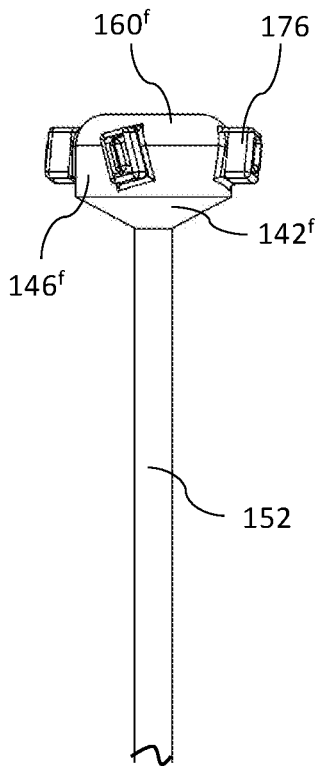
FIG. 15A constitutes a side view of an upper portion of a sprinkler assembly equipped with a rotary expandable nozzle head in a retracted state, according to some embodiments.
Figure 15B:
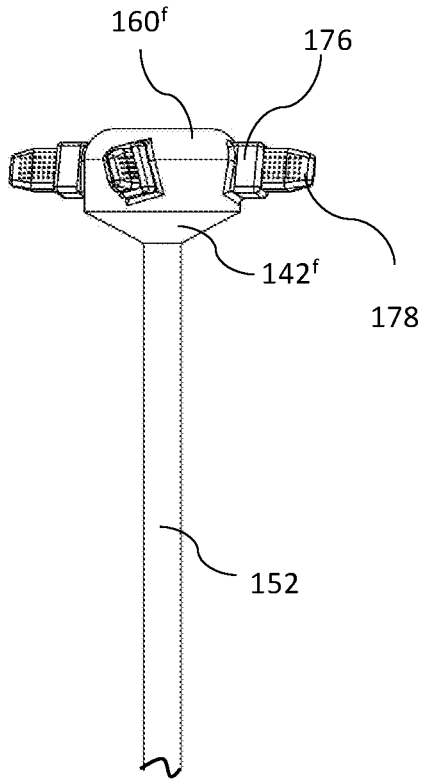
FIG. 15B constitutes a side view of an upper portion of a sprinkler assembly equipped with a rotary expandable nozzle head in an extracted state, according to some embodiments.
Figure 18A:
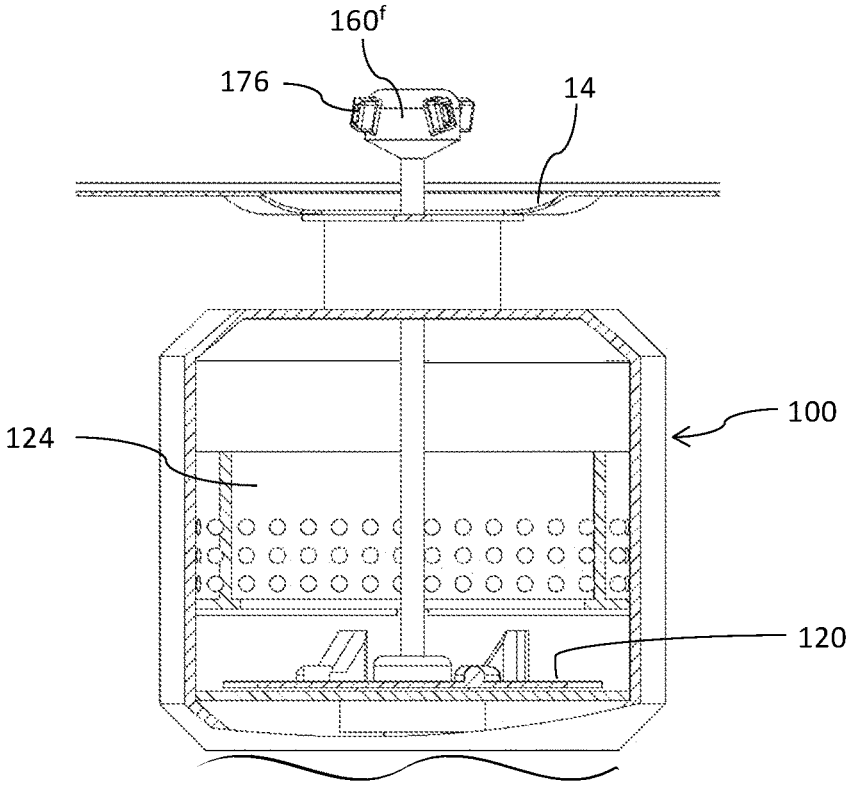
FIG. 18A constitutes a partial cross-sectional side view of an upper portion of a waste disposer mounted underneath a sink, in a top position of a sprinkler assembly equipped with a rotary expandable nozzle head in a retracted state, according to some embodiments.
Figure 18B:
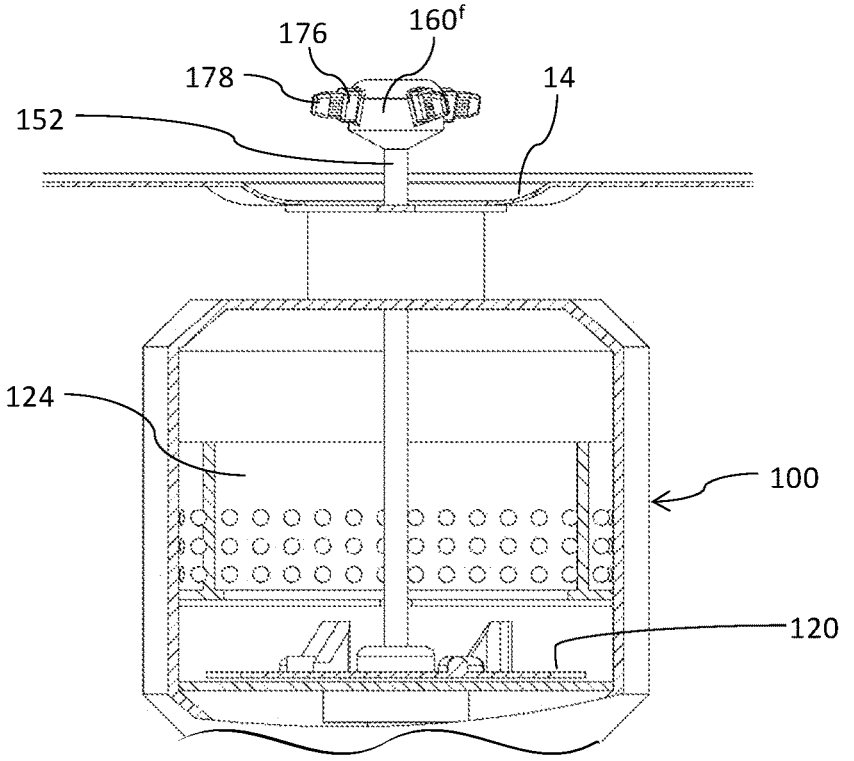
FIG. 18B constitutes a partial cross-sectional side view of an upper portion of a waste disposer mounted underneath a sink, in a top position of a sprinkler assembly equipped with a rotary expandable nozzle head in an extracted state, according to some embodiments.

Reference in now made to FIGS. 15A-18B. According to some embodiments, nozzle head 160 is a rotary expandable nozzle head 160$^f$ configured to rotate about central axis 50. FIGS. 15A-15B constitute side views of an upper portion of a sprinkler assembly 140$^f$ in a retracted and an extracted state, respectively, according to some embodiments. FIG. 15C constitutes a view in perspective of rotary expandable nozzle head 160$^f$ in an extracted state. FIGS. 16A-16B constitutes a cross-sectional side view and a side view of waste disposer 100 mounted underneath sink 10, in a bottom position and a top positions, respectively, of a sprinkler assembly 140$^f$. FIGS. 17A-17B constitute partial cut-away views in perspective of waste disposer 100 mounted underneath sink 10, in a top position of sprinkler assembly 140$^f$ equipped with rotary expandable nozzle head 160$^f$ in a retracted and an extracted state, respectively. FIGS. 18A-18B constitute partial cross-sectional side views of waste disposer 100 mounted underneath sink 10, in a top position of sprinkler assembly 140$^f$ equipped with rotary expandable nozzle head 160$^f$ in a retracted and an extracted state, respectively.

Rotary expandable nozzle head 160$^f$ is rotateably connected to sprinkler tube 152, configured to rotate about central axis 50. Rotary expandable nozzle head 160$^f$ comprises a nozzle distal section 142$^f$ and a nozzle proximal section 146$^f$ (see FIGS. 15A-15B). According to some embodiments, nozzle distal section 142$^f$ is configured to rotateably attach to sprinkler tube 152, for example via a bearing such as a flat bearing or a ball bearing (not shown).

Rotary expandable nozzle head 160$^f$ further comprises at least one lateral nozzle member 178, preferably a plurality of lateral nozzle members 178 disposed circumferentially around nozzle proximal section 146$^f$, each lateral nozzle member 178 equipped with at least one orifice, such as nozzle apertures 148 (see FIG. 15C) or nozzle slots 150.

According to some embodiments, each lateral nozzle member 178 is an extendable lateral nozzle member 180, configured to extend radially outwards from the circumference of nozzle proximal section 146$^f$.

According to some embodiments, rotary expandable nozzle head 160$^f$ further comprises a plurality of lateral head outlets 176 matching in number the amount of lateral nozzle member 178. Each lateral head outlet 176 comprises an outlet opening (not numbered) configured to allow passage or extension of lateral nozzle member 178 therethrough.

According to some embodiments, each lateral head outlet 176 is in a form of a flat opening disposed around the circumference of nozzle proximal section 146$^f$ (embodiment not shown). According to some embodiments, each lateral head outlet 176 is in a form of a sleeve, wherein the sleeve radially extends from the circumference of nozzle proximal section 146$^f$ (see FIG. 15C).

Figure 15C:
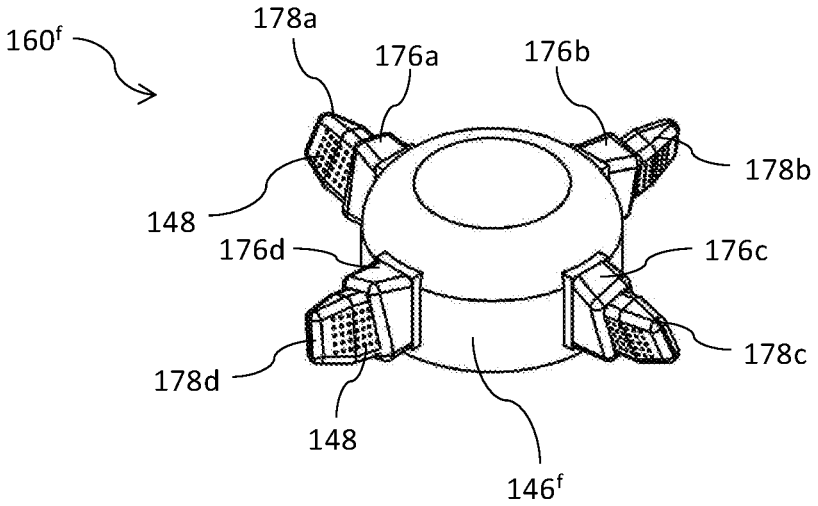
FIG. 15C constitutes a view in perspective of a rotary expandable nozzle head in an extracted state, according to some embodiments.
Figure 16B:
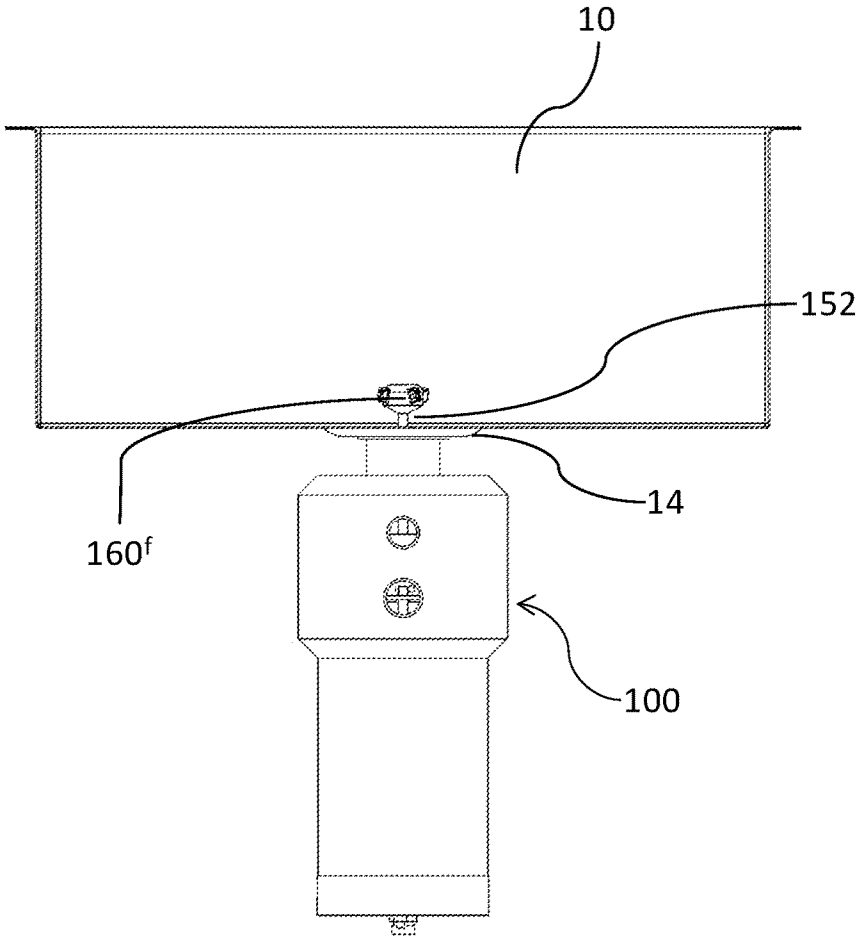
FIG. 16B constitutes a side view of a waste disposer mounted underneath a sink, in a top position of a sprinkler assembly equipped with a rotary expandable nozzle head, according to some embodiments.
Figure 16A:
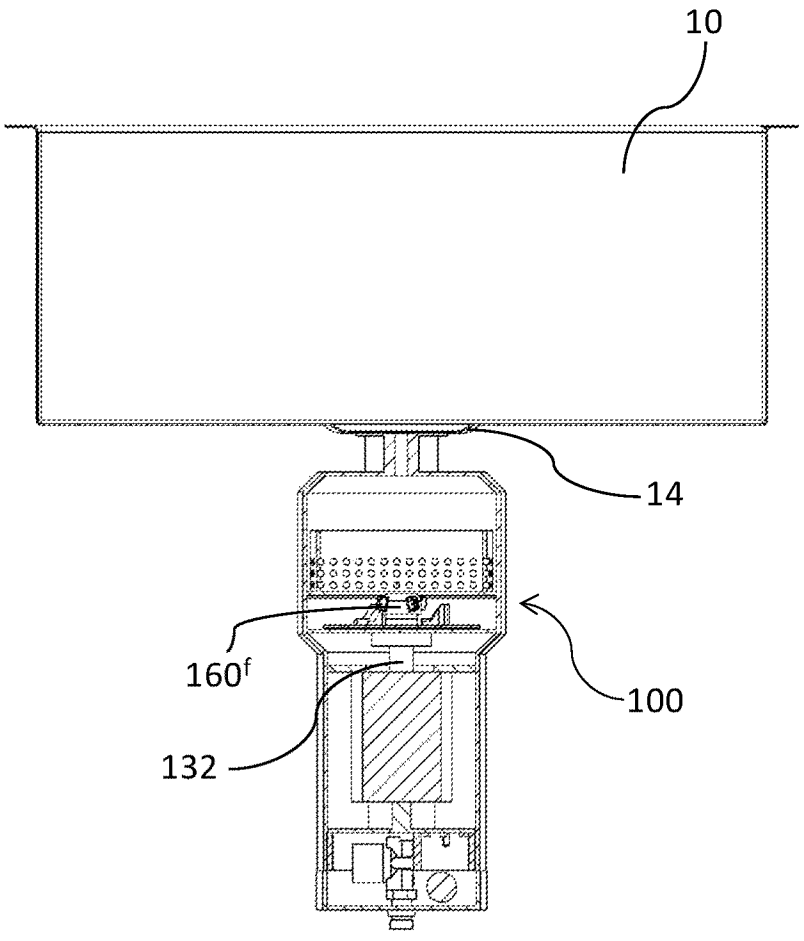
FIG. 16A constitutes a cross-sectional side view of a waste disposer mounted underneath a sink, in a bottom position of a sprinkler assembly equipped with a rotary expandable nozzle head, according to some embodiments.
Figure 17B:
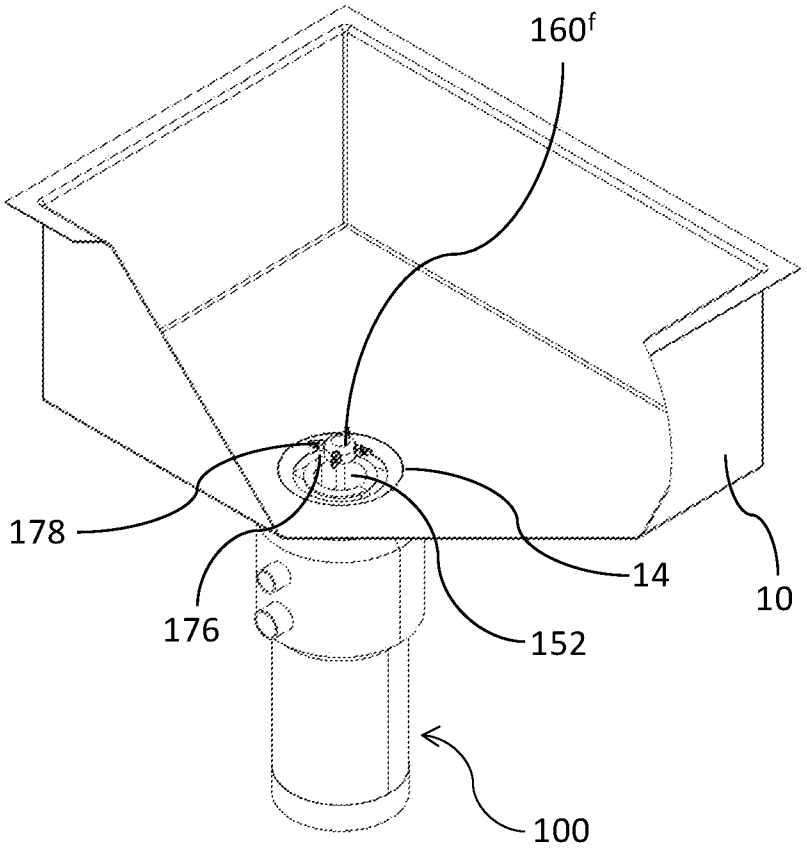
FIG. 17B constitutes a partial cut-away view in perspective of a waste disposer mounted underneath a sink, in a top position of a sprinkler assembly equipped with a rotary expandable nozzle head in an extracted state, according to some embodiments.
Figure 17A:
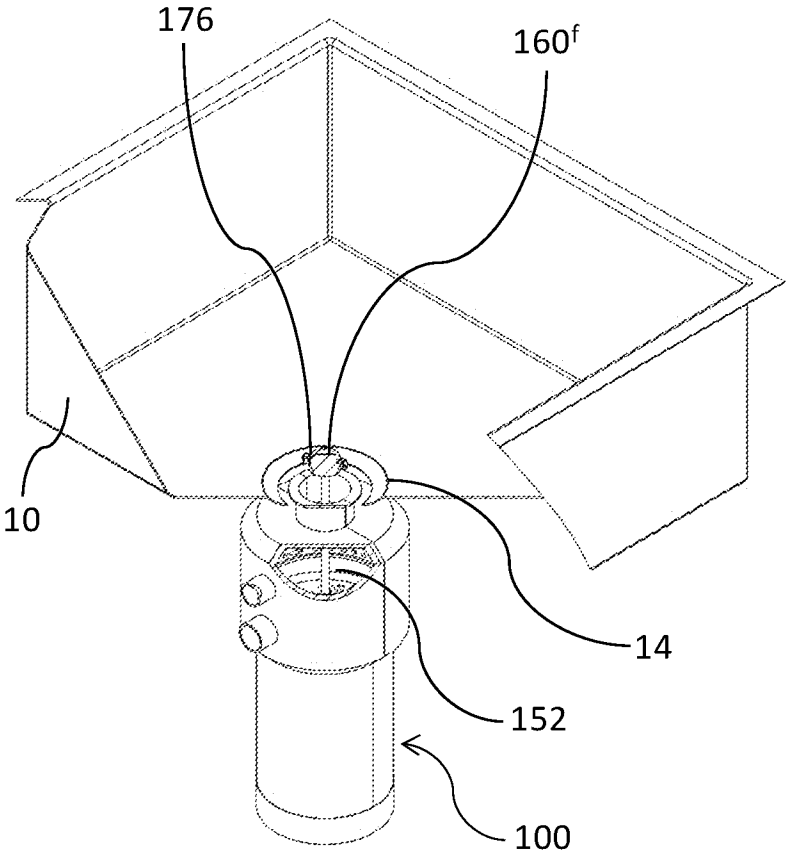
FIG. 17A constitutes a partial cut-away view in perspective of a waste disposer mounted underneath a sink, in a top position of a sprinkler assembly equipped with a rotary expandable nozzle head in a retracted state, according to some embodiments.

According to some embodiments, at least one of lateral head outlet 176 or lateral nozzle member 178, preferably all lateral head outlets 176 and lateral nozzle members 178, are oriented in such a manner that jet streams passing through nozzle apertures 148 or nozzle slots 150 exert a tangential force on rotary expandable nozzle head 160$^f$ so as to impart rotational movement thereof. FIG. 15C depicts an exemplary rotary expandable nozzle head 160$^f$ equipped with four equally spaced sets of lateral head outlets 176 and lateral nozzle members 178, twisted so as to impart rotary movement of rotary expandable nozzle head 160$^f$ when water jets stream through nozzle orifices 148, 150.

According to some embodiments, rotary expandable nozzle head 160$^f$ is maintained in a retracted state, in which all lateral nozzle members 178 are retracted within nozzle proximal section 146$^f$ (for example, via springs) as long as no external force is acting there upon to push them outwards (see FIG. 15A). An extracted state of rotary expandable nozzle head 160$^f$ (see FIG. 15B) is defined as a state in which pressure exerted on lateral nozzle members 178 by pressurized water flowing from sprinkler tube 152, is high enough so that all lateral nozzle members 178 are radially pushed or extended outwards through corresponding lateral head outlets 176.

According to some embodiments, rotary expandable nozzle head 160$^f$ is maintained in a retracted state while in a bottom position (see FIG. 16A) or intermediate positions, and potentially higher or even top position (see FIGS. 16B, 17A and 18A), of sprinkler assembly 140$^f$. According to some embodiments, rotary expandable nozzle head 160$^f$ is in an extracted state when water pressure within nozzle proximal section 146$^f$ overcomes the force required to expand lateral nozzle members 178 outwards, while sprinkler assembly 140' is in a higher position or a top position (see FIGS. 17B and 18B).

According to some embodiments, control circuitry 180 comprises a microprocessor. According to some embodiments, control circuitry 180 comprises a memory. According to some embodiments, control circuitry 180 comprises multiple pre-programed operation cycles or behaviors stored in a memory thereof. According to some embodiments, control circuitry 180 comprises a communication module, configured for wired or wireless communication for receiving instructions from a remote device.

According to some embodiments, control circuitry 180 controls at least one of the following functions: On/Off operation of motor 134 to control operation of grinding mechanism 118; On/Off operation of water inlet valve 172 to control operation of sprinkler tube 152 and nozzle head 160; the degree by which water inlet valve 172 is opened; the height of nozzle head 160 or the force of water jets emanating therefrom; the rotation speed motor 134 or shredder plate 120; and On/Off operation of detergent valve 174.

According to some embodiments, control circuitry 180 comprises an internal clock that handles timing functions and internal counters for any functions operable by control circuitry 180.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable to sub-combination or as suitable in any other described embodiment of the invention. No feature described in the context of an embodiment is to be considered an essential feature of that embodiment, unless explicitly specified as such.

Although the invention is described in conjunction with specific embodiments thereof, it is evident that numerous alternatives, modifications and variations that are apparent to those skilled in the art may exist. It is to be understood that the invention is not necessarily limited in its application to the details of construction and the arrangement of the components and/or methods set forth herein. Other embodiments may be practiced, and an embodiment may be carried out in various ways. Accordingly, the invention embraces all such alternatives, modifications and variations that fall within the scope of the appended claims.

The invention claimed is:

1. A waste disposer comprising:

(i) a housing comprising
  (a) a first inlet;
  (b) an outlet; and
  (c) a pressurized water inlet;

(ii) a grinding mechanism comprising:
  (a) a shredder plate comprising a shredder plate opening and at least one surface feature; and
  (b) a stationary grind ring comprising a plurality of stationary grind apertures disposed there around;

(iii) a motor unit, comprising
  (a) a motor; and
  (b) a central shaft (iv) a sprinkler assembly comprising:
  (a) a sprinkler tube, mounted in a vertical slideable movement within the central shaft, the sprinkler tube comprising a sprinkler tube proximal end and a sprinkler tube distal end;
  (b) a nozzle head connected to the sprinkler tube proximal end, configured for discharging water therefrom, and
  (c) a spring extending between the sprinkler tube distal end and the shredder plate,
  wherein the stationary grind ring is affixed to the housing;

wherein the motor is configured to impart rotational movement of the shredder plate relative to the stationary grind ring;

wherein the shredder plate opening is configured to allow passage of the sprinkler tube therethrough, and wherein the sprinkler assembly is moveable between a bottom position and an upper position.

2. The waste disposer of claim 1, further comprising a second inlet.

3. The waste disposer of claim 1, wherein the motor is configured to impart rotational movement to the central shaft, which rotates the shredder plate.

4. The waste disposer of claim 1, further comprising a water inlet valve, disposed between the sprinkler tube and the pressurized water inlet.

5. The waste disposer of claim 1, further comprising a control circuitry, configured to control the operation of at least one of: the motor and the sprinkler tube.

6. The waste disposer of claim 5, wherein the control circuitry is activated by a remote controller.

7. The waste disposer of claim 1, further comprising a detergent valve, configured to introduce detergent to be mixed with water inflow flowing through the pressurized water inlet.

8. The waste disposer of claim 1, further comprising a sealing cap disposed around the shredder plate opening, comprising a cap opening configured to allow passage of the sprinkle tube therethrough.

9. The waste disposer of claim 1, wherein the shredder plate comprises a plurality of surface features extending upwardly therefrom.

10. The waste disposer of claim 1, wherein the plurality of stationary grind apertures are surrounded by cutting edges.

11. The waste disposer of claim 1, wherein the nozzle head is removably attached to the sprinkler tube proximal end.

12. The waste disposer of claim 1, wherein the nozzle head comprises a plurality of orifices.

13. The waste disposer of claim 12, wherein at least some of the plurality of orifices are formed as nozzle apertures having a diameter of 0.25-0.35 millimeters.

14. The waste disposer of claim 1, wherein the nozzle head is rotateably connected to the sprinkler tube.

15. The waste disposer of claim 14, wherein the nozzle head is rotateably connected to the sprinkler tube, and wherein at least some of the plurality of orifices are oriented so as to impart rotational movement to the nozzle head.

16. The waste disposer of claim 1, further comprising a strainer configured to attach to a distal end of the nozzle head.

17. The waste disposer of claim 16, wherein the strainer is magnetically attached to the nozzle head.

18. The waste disposer of claim 1, wherein the nozzle head is a rotary expandable nozzle head having a nozzle proximal section, comprising at least one lateral nozzle member disposed circumferentially around the nozzle proximal section, wherein the rotary expandable nozzle head is rotateably connected to the sprinkler tube.

19. The waste disposer of claim 18, wherein the rotary expandable nozzle head further comprises at least one lateral head outlet, comprising an outlet opening configured to allow passage or extension of the lateral nozzle member therethrough, and wherein the lateral head outlet is formed as a sleeve radially extending from the circumference of the nozzle proximal section.

20. The waste disposer of claim 19, wherein at least one of the lateral head outlet or the lateral nozzle member are oriented or twisted so as to impart rotary movement of the rotary expandable nozzle head.

* * * * *